US011685592B2

(12) United States Patent
Chen

(10) Patent No.: US 11,685,592 B2
(45) Date of Patent: Jun. 27, 2023

(54) HIGH-PRESSURE SPRAY CAN AND VALVE MECHANISM FOR HIGH-PRESSURE SPRAY CAN

(71) Applicant: MOTEDO CO., LTD., Taipei (TW)

(72) Inventor: Han-Liang Chen, Taipei (TW)

(73) Assignee: Motedo Co., Ltd., Taipei (TW)

( * ) Notice: Subject to any disclaimer, the term of this patent is extended or adjusted under 35 U.S.C. 154(b) by 0 days.

(21) Appl. No.: 17/661,213

(22) Filed: Apr. 28, 2022

(65) Prior Publication Data

US 2022/0371815 A1 Nov. 24, 2022

(30) Foreign Application Priority Data

May 18, 2021 (TW) ..... 110117936
Mar. 17, 2022 (TW) ..... 111109810

(51) Int. Cl.
*B65D 83/44* (2006.01)

(52) U.S. Cl.
CPC ..... *B65D 83/44* (2013.01)

(58) Field of Classification Search
CPC ..... B65D 83/44
USPC ..... 222/394, 402.1, 635
See application file for complete search history.

(56) References Cited

U.S. PATENT DOCUMENTS 2,755,973 A * 7/1956 Campbell ..... B65D 83/48 222/394
3,315,693 A * 4/1967 Braun ..... F16K 31/58 222/394
3,542,254 A * 11/1970 Davenport ..... B65D 83/44 222/402.19
3,915,390 A * 10/1975 Green ..... B65D 83/48 222/394
4,019,687 A * 4/1977 Green ..... B65D 83/48 222/394
4,277,001 A * 7/1981 Nozawa ..... B05B 11/3014 222/401
4,371,098 A * 2/1983 Nozawa ..... B05B 11/0059 137/853

(Continued)

FOREIGN PATENT DOCUMENTS

CN 105129250 A 12/2015
CN 110577027 A 12/2019

(Continued)

*Primary Examiner* — Paul R Durand
*Assistant Examiner* — Michael J. Melaragno
(74) *Attorney, Agent, or Firm* — Rosenberg, Klein & Lee

(57) ABSTRACT

A valve mechanism for a high-pressure spray can has a switching base, a first ball, and a second ball. The switching base has a first passage, a first suction port, a second passage, and a second suction port. The first passage has a first inclined inner wall surface. The first inclined inner wall surface extends obliquely toward a specific side from the top end to the bottom end of the first passage. The second passage has a second inclined inner wall surface. The second inclined inner wall surface extends obliquely toward the specific side from the bottom end to the top end of the second passage. The first ball and the second ball are respectively mounted in the first passage and the second passage and move along the first inclined inner wall surface and the second inclined inner wall surface to block the first suction port and the second suction port.

19 Claims, 21 Drawing Sheets

(56) References Cited

U.S. PATENT DOCUMENTS 4,572,406 A * 2/1986 Pratt ..... B65D 83/32 222/464.2
4,723,692 A * 2/1988 Meuresch ..... B65D 83/36 222/402.19
4,775,079 A * 10/1988 Grothoff ..... B05B 11/0059 222/402.19
4,872,595 A * 10/1989 Hammett ..... B05B 9/0883 417/540
4,966,313 A * 10/1990 Lina ..... B05B 11/0059 222/402.1
4,978,038 A * 12/1990 Sullivan ..... B65D 83/36 222/402.19
5,119,974 A * 6/1992 Mann ..... B05B 11/3011 222/376
5,222,636 A * 6/1993 Meuresch ..... B05B 11/0059 222/402.19
5,346,104 A * 9/1994 Jeong ..... B65D 83/36 222/402.19
5,348,199 A * 9/1994 Smith ..... B65D 83/565 222/402.1
5,350,088 A * 9/1994 Smith ..... B65D 83/36 222/402.1
5,803,319 A * 9/1998 Smith ..... B65D 83/36 222/402.19
6,186,372 B1 * 2/2001 Garcia ..... B05B 11/0059 222/402.19
6,267,304 B1 7/2001 Schultz
7,677,420 B1 * 3/2010 Greer, Jr. ..... E04B 1/84 222/394
11,053,068 B1 * 7/2021 Chen ..... B05B 15/33
11,261,021 B2 * 3/2022 Chen ..... B65D 83/44
2009/0283547 A1 11/2009 Harrold
2014/0061234 A1 * 3/2014 Eldreth ..... B05B 11/0059 222/105
2021/0107728 A1 4/2021 Nasr et al.
2021/0300670 A1 * 9/2021 Chen ..... B65D 83/32

FOREIGN PATENT DOCUMENTS

CN 212557627 U 2/2021
JP S61103366 U 7/1986
JP 2003019023 A 1/2003
JP 2008105753 A 5/2008
JP 2010254359 A 11/2010
JP 2012106766 A 6/2012
TW 554917 U 9/2003

* cited by examiner

HIGH-PRESSURE SPRAY CAN AND VALVE MECHANISM FOR HIGH-PRESSURE SPRAY CAN

BACKGROUND OF THE INVENTION

1. Field of the Invention

The present invention relates to a spray can for containing and spraying a liquid product, especially to a spray can that always sprays a liquid product smoothly without leaking propellant when the high-pressure spray can is placed upright, upside down, or horizontally to spray.

2. Description of the Prior Arts

Due to consumer demands on the market, diverse spray cans across hundreds of fields have been invented, and therefore spray cans have been generally and widely used in people's daily life. Examples include a hair spray, a kitchen or bath cleaner, and pesticides in the field of personal and household products, carburetor cleaners, air fresheners, and paint sprays in automobiles and industrial supplies, and even a self-defense spray for police officers, security guards, and women to protect themselves, etc.

In a conventional high-pressure spray can for spraying a liquid product, a can body has a can opening on a top end. A valve assembly is fixed on the can opening of the can body to seal the can body. A top end of a dip tube mounted in the can body is connected to the valve assembly. The dip tube is slightly curved, and the bottom end of the dip tube extends toward a same side to which a nozzle of an actuator mounted on the top end of the can body faces. A drawing opening formed on the bottom end of the dip tube is placed in a corner where the can wall and the can bottom are connected, so the drawing opening is always immersed in the liquid product at the bottom of the can body. When in use, the can body is filled with the liquid product and propellant, which is usually compressed gas such as nitrogen $N_2$. The pressure of the propellant pushes the liquid product to flow into the dip tube, pass the valve assembly, and be sprayed via the nozzle of the actuator.

The key to the principle of operation of the high-pressure spray can is as follows: After the dip tube and the valve assembly are assembled and the can body is sealed, the actual available volume inside the can body is filled with 70% of liquid product and 30% of propellant (such as nitrogen $N_2$). This volume ratio is formulated to make sure the liquid product and the propellant will both be completely sprayed out in the end. Since the nitrogen $N_2$ is lyophobic and is lighter than air in specific gravity, the nitrogen $N_2$ floats above the liquid surface in the sealed can body. To be specific, the drawing opening on the bottom end of the dip tube must be immersed in the liquid product so that after a user presses the actuator to open a valve stem of the valve assembly, the liquid product will be pushed by the propellant to flow into the drawing opening, to pass through the valve assembly, and to be sprayed out from the nozzle of the actuator. Otherwise, if the drawing opening of the dip tube is exposed in the propellant instead of being immersed in the liquid product, after the user press the actuator, the propellant will immediately leak from the valve assembly but the liquid product will not be pushed and sprayed out, and finally residues of the liquid product are left in the can body and wasted. In other words, when a traditional high-pressure spray can is placed upside down to spray and the remaining liquid product is equal to or less than a half, since the top end of the can body is placed downward toward the ground, the liquid product flows downward to the top end of the can body and the propellant flows upward to the bottom end of the can body. However, the drawing opening of the dip tube is still located in the bottom end of the can body and therefore is exposed in the propellant. Thus, after the user presses the actuator, the liquid product cannot flow into the drawing opening which is located above the liquid product, but the propellant immediately flows into the drawing opening, passes through the valve assembly, and leaks from the nozzle of the actuator. Finally, residues of the liquid product are left in the can body and thus wasted, and that is the disadvantage of the traditional high-pressure spray can.

In order to solve the problem that the traditional high-pressure spray can does not work when placed upside down to spray, a side-ball type valve mechanism that can spray when the can body is placed upside down is invented. With reference to FIGS. 14 to 17, a conventional high-pressure spray can with a side-ball type valve mechanism is shown. The side-ball type valve mechanism has a valve assembly 911, a switching base 912, a dip tube 92, an inverted-spraying suction port 93, and a ball 94. The dip tube 92 has an upright-spraying suction port 921.

With reference to FIG. 14, when the high-pressure spray can is placed upright to spray, the ball 94 slides downward and blocks the inverted-spraying suction port 93, and the upright-spraying suction port 921 of the dip tube 92 is immersed in the liquid product A inside the can body. After the user presses the actuator 98 to open the valve stem of the valve assembly 911, the pressure of the propellant B pushes the liquid product A to flow into the upright-spraying suction port 921, and the liquid product A sequentially passes through the upright-spraying passage 922, the common passage 923, the liquid product inlet 924, and the liquid product outlet 925, and then is sprayed out from the nozzle 981 of the actuator 98.

With reference to FIG. 15, when the high-pressure spray can is placed upside down to spray, the actuator 98 is placed toward the ground and the liquid product A flows downward. At the same time, the ball 94 is driven by the gravity and slides down to open the inverted-spraying suction port 93, and the inverted-spraying suction port 93 is immersed in the liquid product A at that moment. Thus, after the user presses the actuator 98 to open the valve stem 312 of the valve assembly 911, the pressure of the propellant B pushes the liquid product A to flow into the inverted-spraying suction port 93, and then the liquid product A sequentially passes through the inverted-spray passage 931, the common passage 923, the liquid product inlet 924, and the liquid product outlet 925, and then is sprayed out from the nozzle 981 of the actuator 98.

In other words, the switching base 912 of the side-ball type valve mechanism is of a single ball and a single passage. However, though the side-ball type valve mechanism, spraying is operable when the can body is placed upside down but the side-ball type valve mechanism still has disadvantages as follows:

First, with reference to FIGS. 14 and 15, when the high-pressure spray can is placed upright to spray, the ball 94 is driven by the gravity and slides down to block the inverted-spraying suction port 93, and the upright-spraying suction port 921 of the dip tube 92 is immersed in the liquid product A, so the propellant B above the liquid surface will not leak from the inverted-spraying suction port 93 and the high-pressure spray can sprays. Besides, when the high-pressure spray can is placed upside down to spray, the ball 94 slides down toward the ground and opens the inverted-spraying suction port 93, and the inverted-spraying suction port 93 is immersed in the liquid product A at that moment, so the high-pressure spray can sprays as well. However, when the high-pressure spray can sprays while the can body is placed upside down, the upright-spraying suction port 921 of the dip tube 92 is not immersed in the liquid product A but exposed in the propellant B above the liquid surface instead, the propellant B will instantly be sprayed out from the upright-spraying suction port 921 of the dip tube 92 simultaneously through the common passage 923. In other words, though the side-ball type valve mechanism spraying is enabled when the can body is placed upside down, since there is not a component blocking the upright-spraying suction port 921 of the dip tube 92 during spraying when the can body is placed upside down, the propellant B leaks at the same time during the spraying, and therefore residues of the liquid product A will be left in the can body after the propellant B runs out.

Second, with reference to FIG. 16, when the high-pressure spray can is placed horizontally to spray, since a wall that supports the ball 94 is horizontal, the ball 94 will not stay at a position that opens or closes the inverted-spraying suction port 93 due to the force of the gravity. Instead, the ball 94 keeps shifting along the wall left and right and opens or closes the inverted-spraying suction port 93 intermittently. At this time, if the remaining liquid product A is not enough to immerse both the upright-spraying suction port 921 of the dip tube 92 and the inverted-spraying suction port 93, after the user presses the actuator 98 to open the valve stem of the valve assembly 911, the upright-spraying suction port 921 of the dip tube 92 can draw the liquid product A for spraying while the inverted-spraying suction port 93 cannot draw the liquid product A for spraying because the upright-spraying suction port 921 of the dip tube 92 is close to the corner where the can wall and the can bottom are connected and the upright-spraying suction port 921 is immersed in the liquid product A but the inverted-spraying suction port 93 is not. Further, because the ball 94 keeps drifting on the inverted-spraying suction port 93, the propellant B intermittently enters the inverted-spraying suction port 93, passes the common passage 923, and leaks instantly. Meanwhile, the propellant B also collides with the liquid product A drawn from the upright-spraying suction port 921 in the common passage 923 and causes slurping turbulence that makes the liquid product A sprayed out intermittently. All the situations above result in the residue of the liquid product A and the waste of both the liquid product A and the propellant B.

Third, with reference to FIG. 17, when the remaining liquid product A is equal to or less than a half and the high-pressure spray can is inclined toward the ground to spray, the ball 94 is driven by the gravity and slides down to open the inverted-spraying suction port 93, and both the inverted-spraying suction port 93 and the upright-spraying suction port 921 of the dip tube 92 are not immersed in the liquid product A because the liquid product A is not enough. In other words, if the liquid product A is not enough and the high-pressure spray can is inclined with the top end downward, both the inverted-spraying suction port 93 and the upright-spraying suction port 921 of the dip tube 92 will be exposed in the propellant B. In that case, after the user presses the actuator 98 to open the valve stem of the valve assembly 911, the propellant B will immediately enter the inverted-spraying suction port 93 and the upright-spraying suction port 921 of the dip tube 92, passes the common passage 923, and all leaks out instantly while the liquid product A is left in the can body.

To overcome the shortcomings, the present invention provides a high-pressure spray can and a valve mechanism for a high-pressure spray can to mitigate or obviate the aforementioned problems.

SUMMARY OF THE INVENTION

The main objective of the present invention is to provide a high-pressure spray can and a valve mechanism. The valve mechanism has two balls respectively controlling the connection or blocking of the first suction port and the second suction port, and prevents the propellant from leaking when the high-pressure spray can is used in upright or upside-down position. Moreover, with the design of two inclined inner walls of two passages, the two balls can shift quickly in co-motion at the same time. Thus, the high-pressure spray can sprays the liquid product smoothly without leaking the propellant when the high-pressure spray can is placed horizontally to spray, and residues of the liquid product will not be left in the can body at the same time.

The valve mechanism for a high-pressure spray can is intended to be mounted on an opening of a can body and serves as a gate for the flow between an interior and an exterior of the can body. The can body has an inner space and a can-mounting opening. The valve mechanism for a high-pressure spray can has a first reference direction, a second reference direction, a third reference direction, a valve assembly, a switching base, a first ball, and a second ball. The first reference direction is parallel to an axis of the can body and toward a top end of the can body. The second reference direction is vertical to the first reference direction and radially outward of the can body. The third reference direction is parallel to the axis of the can body and toward a bottom end of the can body. The valve assembly is fixed on the can-mounting opening of the can body and seals the can-mounting opening of the can body. The valve assembly has a liquid product inlet and a liquid product outlet. The liquid product inlet is located in the inner space of the can body. The liquid product outlet is located outside the can body and selectively links the flow with the liquid product inlet. The top end of switching base is connected to a bottom end of the valve assembly and links the flow with the valve assembly. The switching base has a main body having a first passage, a first suction port, a second passage, and a second suction port. The first passage has a first end, a second end, a first linking opening, and a first inclined inner wall surface. The first end of the first passage points toward the first reference direction. The second end of the first passage points toward the third reference direction. The first linking opening is formed on the first end of the first passage and links the flow with the liquid product inlet. The first inclined inner wall surface is located in a side of the first passage facing toward the second reference direction. The first inclined inner wall surface is inclined with respect to the axis of the can body and extends obliquely toward the second reference direction from the first end of the first passage to the second end of the first passage. The first suction port links the flow with the first passage. The first suction port links the flow with the liquid product inlet via the first linking opening of the first passage. The second passage has a first end, a second end, a second linking opening, and a second inclined inner wall surface. The first end of the second passage points toward the third reference direction. The second end of the second passage points toward the first reference direction. The second linking opening is formed on the first end of the second passage and links the flow with the liquid product inlet. The second inclined inner wall surface is located in a side of the second passage facing toward the second reference direction. The second inclined inner wall surface is inclined with respect to the axis of the can body and extends obliquely toward the second reference direction from the first end of the second passage to the second end of the second passage. The second suction port linking the flow with the second passage. The second suction port links the flow with the liquid product inlet via the second linking opening of the second passage. The first ball is moveably mounted in the first passage and selectively links or blocks the flow between the first suction port and the liquid product inlet. The second ball is moveably mounted in the second passage and selectively links or blocks the flow between the second suction port and the liquid product inlet. When the can body is placed upright and the first reference direction is perpendicularly upward, the first ball slides down such that the first suction port links the flow with the liquid product inlet, and the second ball blocks the second linking opening such that the second suction port and the liquid product inlet are blocked by the second ball. When the can body is placed upside down and the first reference direction is perpendicularly downward, the second ball slides down such that the second suction port links the flow with the liquid product inlet, and the first ball blocks the first linking opening such that the first suction port and the liquid product inlet are blocked by the first ball. When the can body is placed horizontally and the second reference direction is perpendicularly downward, the first ball abuts the first inclined inner wall surface and stays at a lower end of the first inclined inner wall surface such that the first suction port links the flow with the liquid product inlet, and the second ball abuts the second inclined inner wall surface and stays at a lower end of the second inclined inner wall surface such that the second suction port links the flow with the liquid product inlet.

The high-pressure spray can has a can body, an actuator, and a valve mechanism. The can body has an inner space and a can-mounting opening in fluid communication with the inner space. The actuator has a nozzle. The valve mechanism is as described above. The valve mechanism is mounted on the can body and serves as a gate of the flow between an interior and an exterior of the can body. The first reference direction is parallel to an axis of the can body. The valve assembly is fixed on the can-mounting opening, seals the can-mounting opening, and is connected to the actuator. The liquid product outlet of the valve assembly links the flow with the nozzle of the actuator.

The advantages of the present invention are as follows: The switching base is connected to the bottom end of the valve assembly and has the first passage and the second passage. When the upright-spraying dip tube links the flow with the first suction port and the inverted-spraying dip tube linking the flow with the second suction port, the upright-spraying suction port of the upright-spraying dip tube and the inverted-spraying suction port of the inverted-spraying dip tube are both linking the flow with the liquid product inlet of the valve assembly respectively via the first passage and the second passage. By movably mounting the first ball and the second ball respectively in the first passage and the second passage, the first ball and the second ball are capable of respectively controlling the upright-spraying suction port and the inverted-spraying suction port to link or block the liquid the flow.

Therefore, when the remaining liquid product volume is equal to or less than a half and the can body is placed upright to spray, the first ball is driven by the gravity to slide down such that the upright-spraying suction port links the flow with the liquid product inlet via the first linking opening, the upright-spraying suction port is immersed in the liquid product A, and the second ball is driven by the gravity to slide down and block the second linking opening such that the inverted-spraying suction port and the liquid product inlet are blocked. Further, when the can body is placed upside down to spray, the top end of the can body is placed toward the ground, the second ball is driven by the gravity to slide down such that the inverted-spraying suction port links the flow with the liquid product inlet via the second linking opening, the inverted-spraying suction port is immersed in the liquid product A, and the first ball is driven by the gravity to slide down and block the first linking opening such that the upright-spraying suction port and the liquid product inlet are blocked. In summary, whether the high-pressure spray can of the present invention is placed upright or upside down to spray, there are always balls that block the liquid suction port which is not immersed in the liquid product. Therefore, comparing to the conventional high-pressure spray can, the present invention always sprays the liquid product smoothly without leaking the propellant regardless whether the high-pressure spray can of the present invention is placed upright or upside down to spray, thereby avoiding waste of the liquid product and propellent.

Besides, when the remaining liquid product volume is equal to or less than a half and the can body is placed horizontally to spray, because the first inclined inner wall surface and the second inclined inner wall surface are inclined downward, the first ball abuts the first inclined inner wall surface and quickly moves along the first inclined inner wall surface toward the bottom end of the can body to the lower end of the first inclined inner wall surface, which makes the upright-spraying suction port link the flow with the liquid product inlet. At the same time, the second ball also abuts the second inclined inner wall surface and quickly moves along the second inclined inner wall surface toward the top end of the can body to the lower end of the second inclined inner wall surface, which makes the inverted-spraying suction port link the flow with the liquid product inlet. In other words, when the can body is placed horizontally to spray, because the two inclined inner wall surfaces are inclined downward, the two balls both slide down in co-motion to lower positions and link the two suction ports, and because both the upright-spraying suction port and the inverted-spraying suction port are immersed in the liquid product A, the two suction ports are capable of spraying the liquid product. Therefore, the two balls will not drift in the passages to randomly link or block the two suction ports and disturb the flow of the liquid product, so the liquid product is sprayed smoothly without intermitted slurping.

Other objectives, advantages and novel features of the invention will become more apparent from the following detailed description when reference in conjunction with the accompanying drawings.

DETAILED DESCRIPTION OF THE PREFERRED EMBODIMENTS

Figure 1:
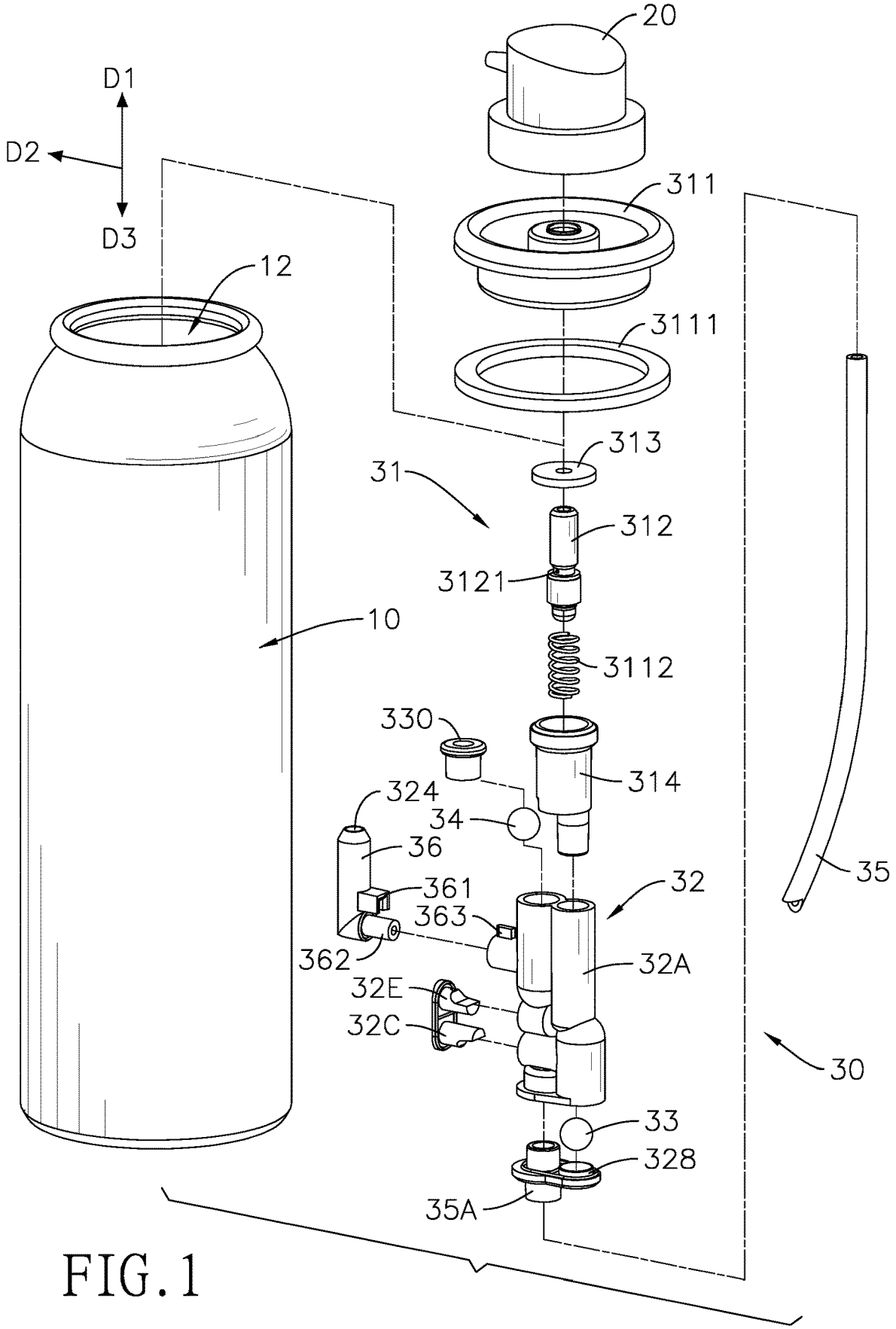
FIG. 1 is an exploded view of a first embodiment of a high-pressure spray can in accordance with the present invention.
Figure 2:
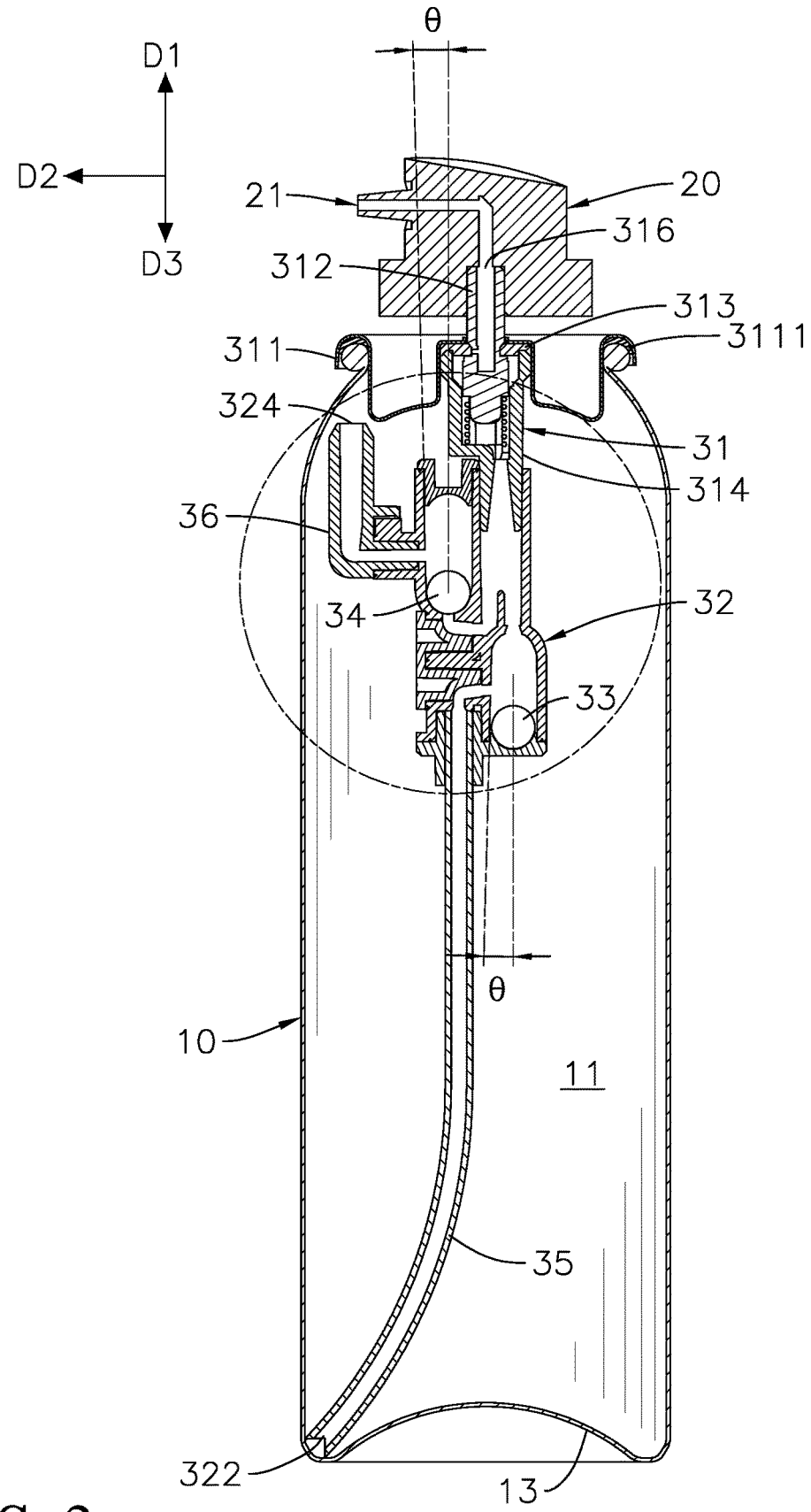
FIG. 2 is a side view in cross-section of a first embodiment of the high-pressure spray can in FIG. 1.

With reference to FIGS. 1 and 2, a first embodiment of a high-pressure spray can in accordance with the present invention comprises a can body 10, an actuator 20, and a valve mechanism 30. The valve mechanism 30 has a valve assembly 31 and a switching base 32. The valve assembly 31 is fixed on a can-mounting opening 12 of the can body 10, seals the can-mounting opening 12, and is a gate between an interior and an exterior of the can body 10. A top end of the switching base 32 is mounted on a bottom end of the valve assembly 31, and the switching base 32 links the flow with the valve assembly 31. The actuator 20 has a nozzle 21 being horizontal, and the actuator 20 is mounted on a top end of the valve assembly 31 and links the flow with the valve assembly 31.

With reference to FIGS. 1 and 2, the can body 10 has an inner space 11, the aforementioned can-mounting opening 12, and a bottom wall 13. The aforementioned can body 10 is hollow and has the can-mounting opening 12. In the first embodiment, the can body 10 is preferably made of metal. The can-mounting opening 12 is located in a top end of the can body 10. In the first embodiment, a bottom end of the can body 10 forms a curved bottom wall 13. The bottom wall 13 is concave toward the inner space 11 of the can body 10, and the can body 10 stands on the ground with an edge of the bottom wall 13 abutting the ground.

Figure 3:
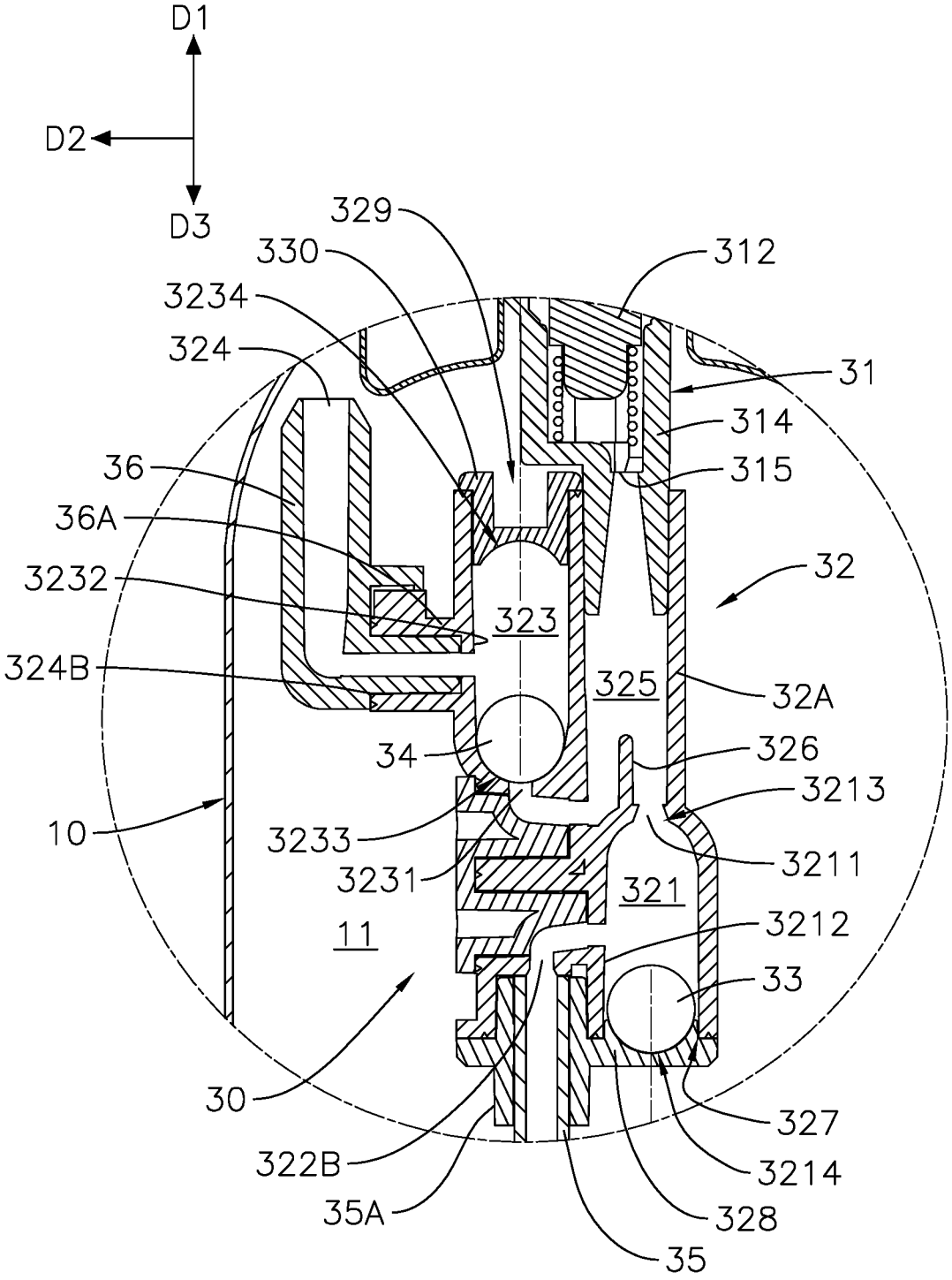
FIG. 3 is a partial enlarged view of FIG. 2.

With reference to FIGS. 2 and 3, the valve mechanism 30 is mounted on the can body 10 and is linking the flow between an interior and an exterior of the can body 10. The valve mechanism 30 has a first reference direction D1, a second reference direction D2, a third reference direction D3, the aforementioned valve assembly 31, the aforementioned switching base 32, a first ball 33, a second ball 34, an upright-spraying dip tube 35, and an inverted-spraying dip tube 36. The first reference direction D1 is parallel to an axis of the can body 10, and is toward the top end of the can body 10. The second reference direction D2 is vertical to the first reference direction D1 and is radially outward of the can body 10. The third reference direction D3 is parallel to the axis of the can body 10 and is toward the bottom end of the can body 10.

With reference to FIGS. 1, 2 and 3, the valve assembly 31 has a liquid product inlet 315 and a liquid product outlet 316. The liquid product inlet 315 is located in the inner space 11 of the can body 10. The liquid product outlet 316 is located outside the can body 10. The liquid product inlet 315 is selectively linking the flow with the liquid product outlet 316. Specifically, with reference to FIGS. 1, 2 and 3, the valve assembly 31 has a valve housing 314, a valve stem 312, and a mounting cup 311 which is made of metal. The valve housing 314 is mounted on a bottom of the mounting cup 311. The mounting cup 311 is fixed on the can-mounting opening 12 of the can body 10 and seals the can-mounting opening 12. The liquid product inlet 315 is formed on a bottom of the valve housing 314. The valve stem 312 is a tube and has a lateral orifice 3121. A bottom end of the valve stem 312 is mounted in the valve housing 314. A top end of the valve stem 312 is mounted through a center of the mounting cup 311 and the valve stem 312 protrudes outwards from the bottom of the mounting cup 311. The top end of the valve stem 312 forms a liquid product outlet 316. The liquid product A flows to the liquid product outlet 316 via the common passage 325 of the valve assembly 31, the liquid product inlet 315, and the lateral orifice 3121 of the valve stem 312. In the first embodiment, the actuator 20 is an accessory product of high-pressure spray can and mounted on the liquid product outlet 316 located on the top end of the valve stem 312. The nozzle 21 of the actuator 20 links the flow with the liquid product outlet 316 of the valve stem 312. After the user presses the actuator 20, the valve stem gasket 313 will be relaxed from the lateral orifice 3121 of the valve stem 312, and the valve assembly 31 starts to spray the liquid product A. Conventionally, the horizontal nozzle 21 of the actuator 20 points toward a same side to which the curved upright-spraying suction port 322 of the upright-spraying dip tube 35 points. Since the valve assembly 31 is a conventional component, the other detailed structure will not be elaborated below. In the first embodiment, the valve assembly 31 is of 1-inch specification. With reference to FIG. 1, the conventional valve assembly 31 consists of 7 components which are a valve stem 312, a valve stem gasket 313, a mounting cup 311, a mounting cup gasket 3111, a valve housing 314, a spring 3112, and an upright-spraying dip tube 35.

Figure 9A:
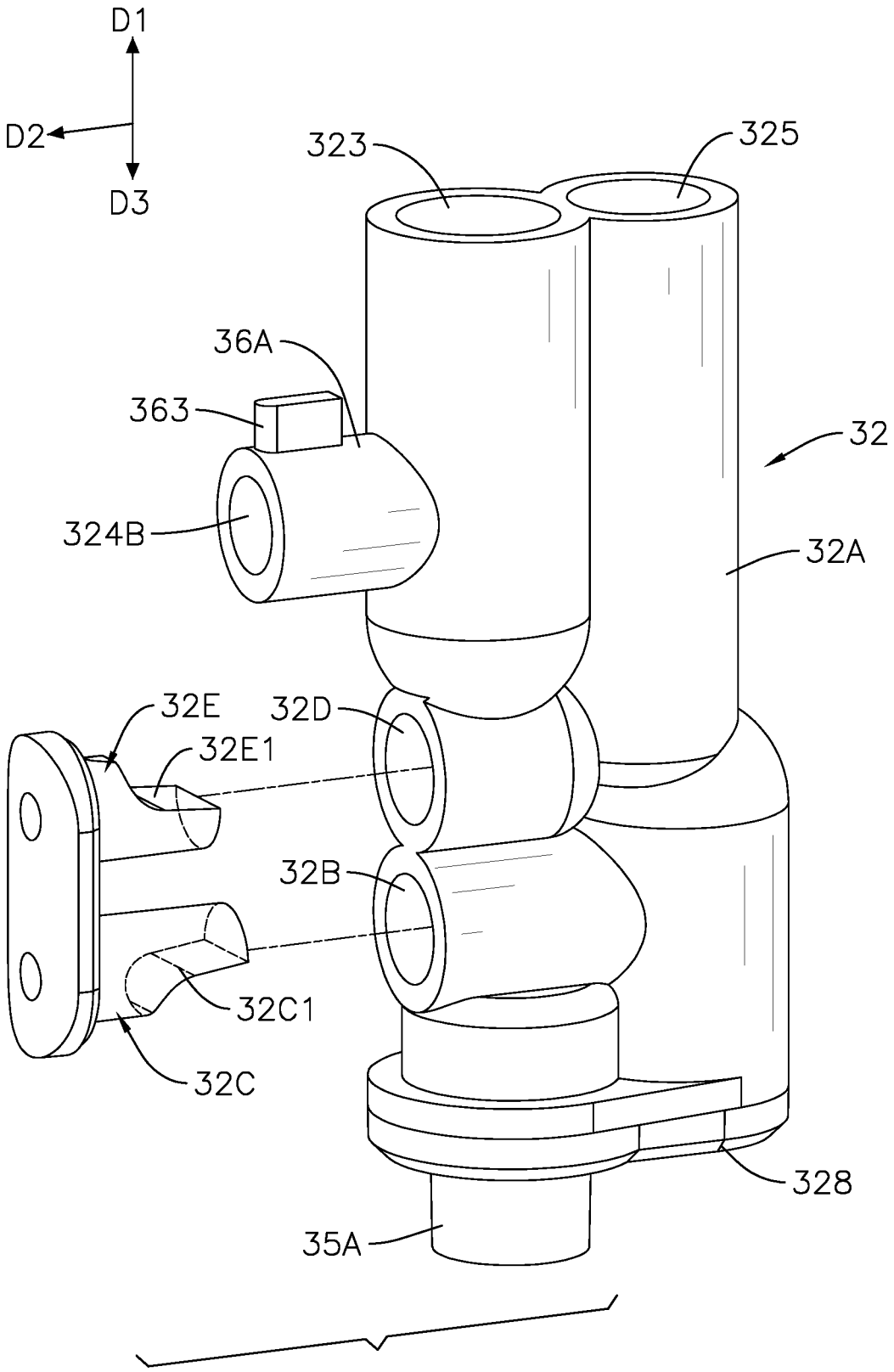
FIG. 9A is an exploded view of a first embodiment of the high-pressure spray can in FIG. 1, showing the switching base.
Figure 9B:
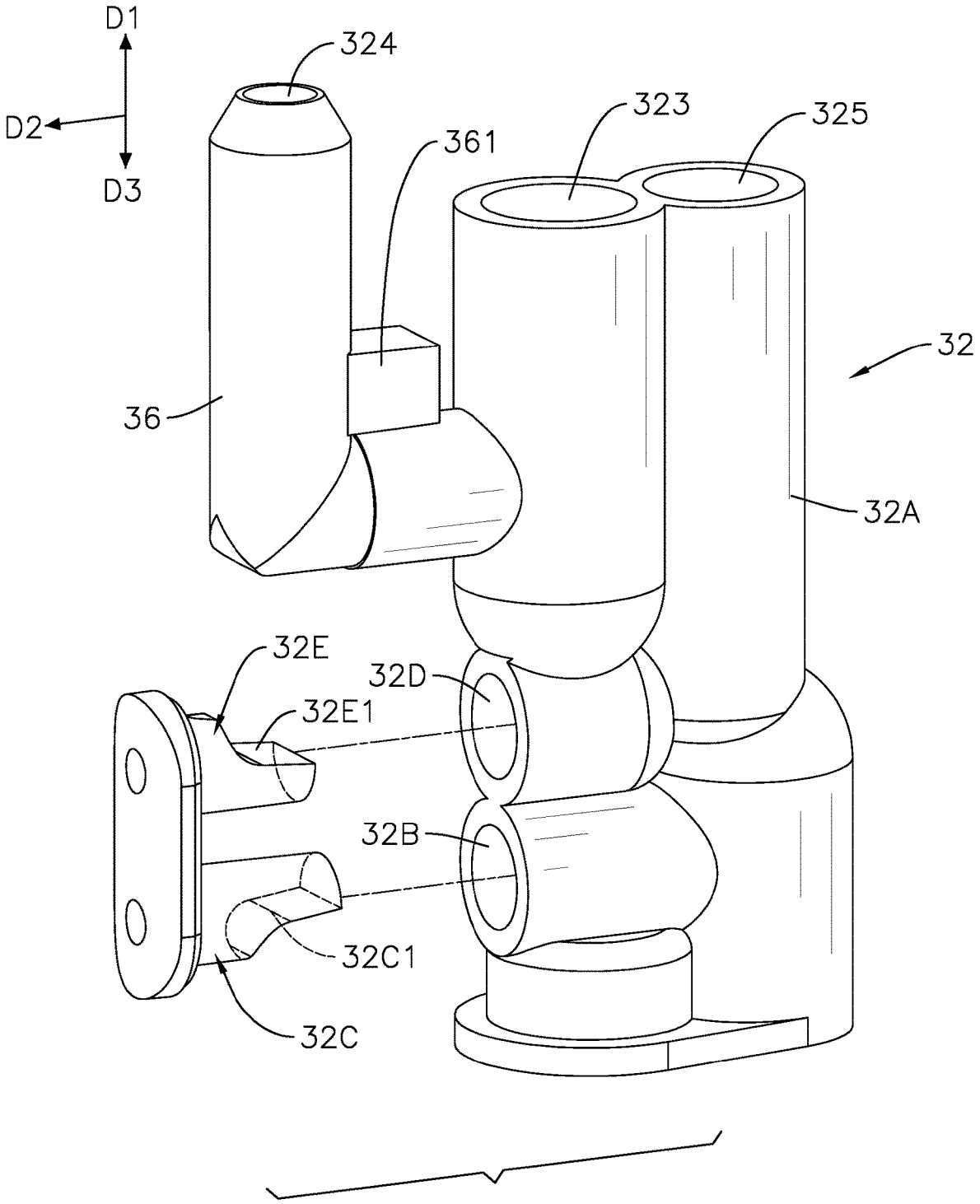
FIG. 9B is a perspective view of a first embodiment of the high-pressure spray can in FIG. 1, showing an assembly of the switching base and the inverted-spraying dip tube.
Figure 10:
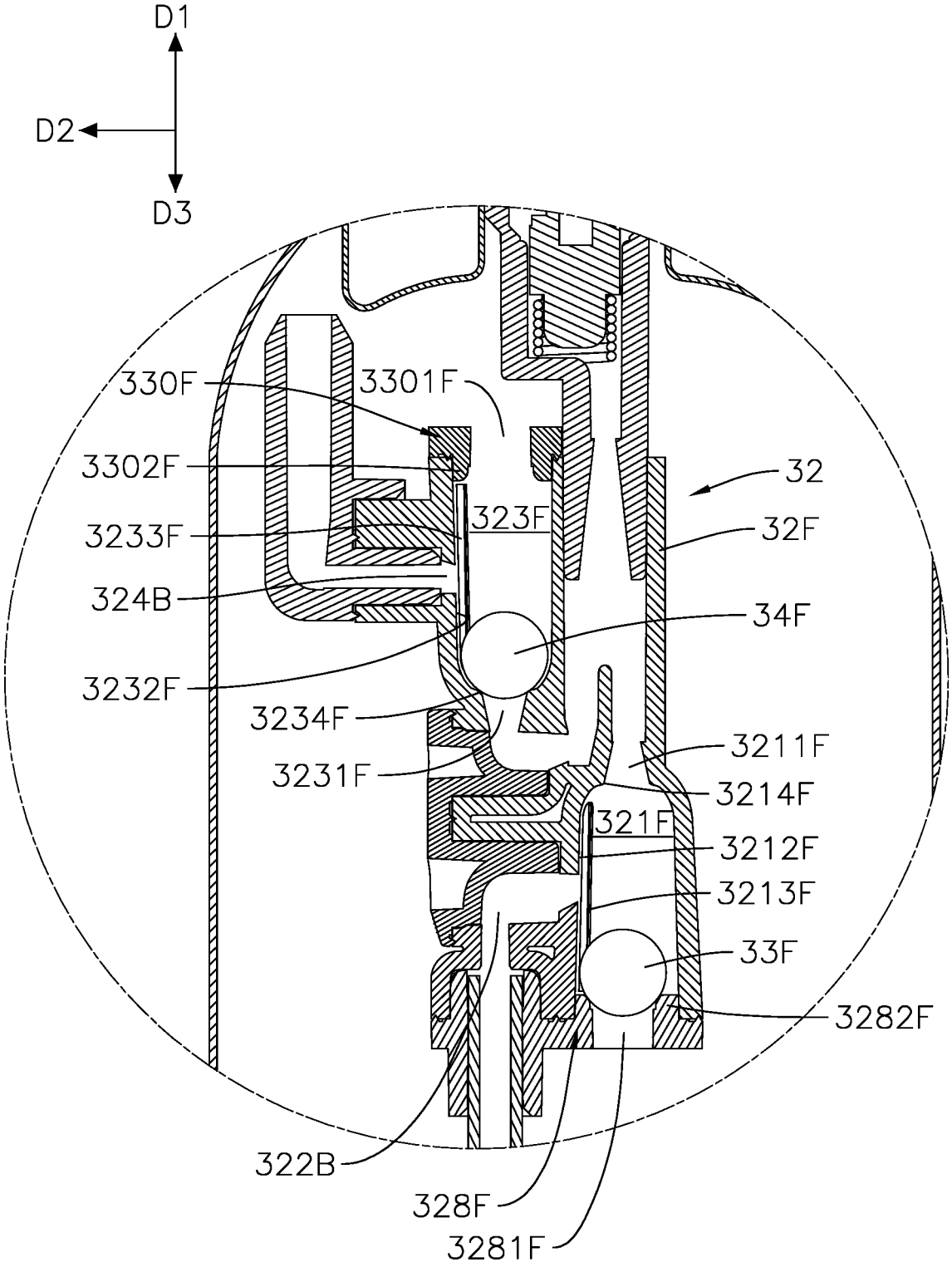
FIG. 10 is a partial enlarged view of a second embodiment of a high-pressure spray can in accordance with the present invention.
Figure 11A:
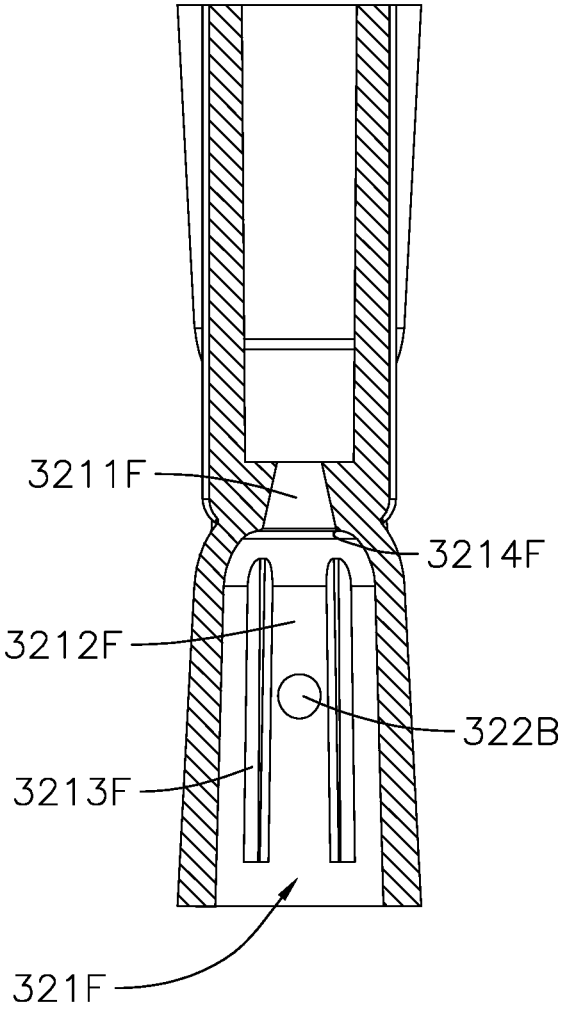
FIG. 11A is a side view in cross-section of the second embodiment of the high-pressure spray can in FIG. 10, showing the first passage.
Figure 11B:
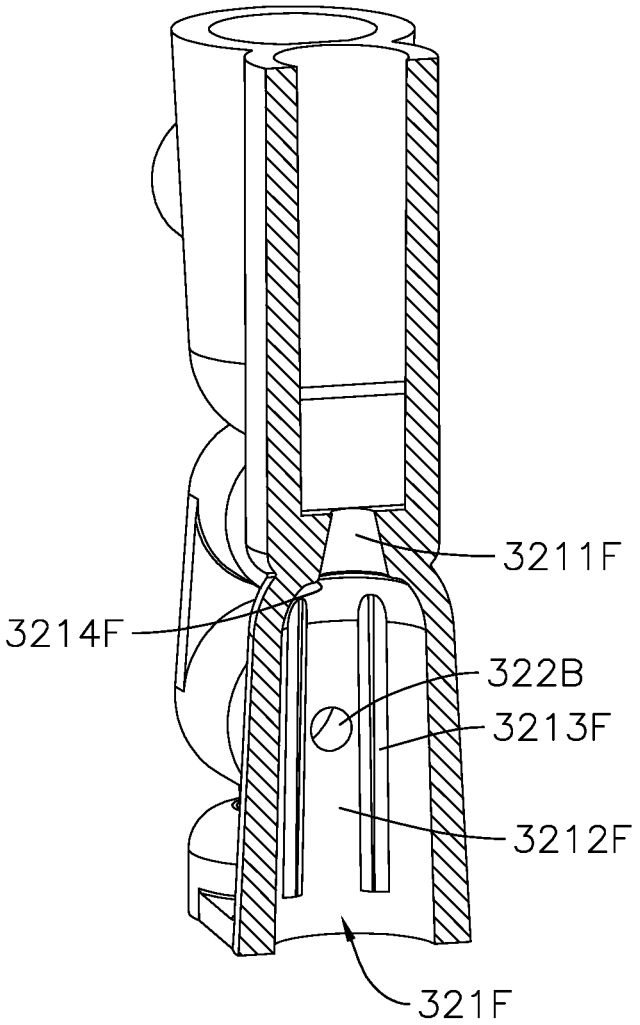
FIG. 11B is a perspective view in cross-section of the second embodiment of the high-pressure spray can in FIG. 10, showing the first passage.
Figure 12A:
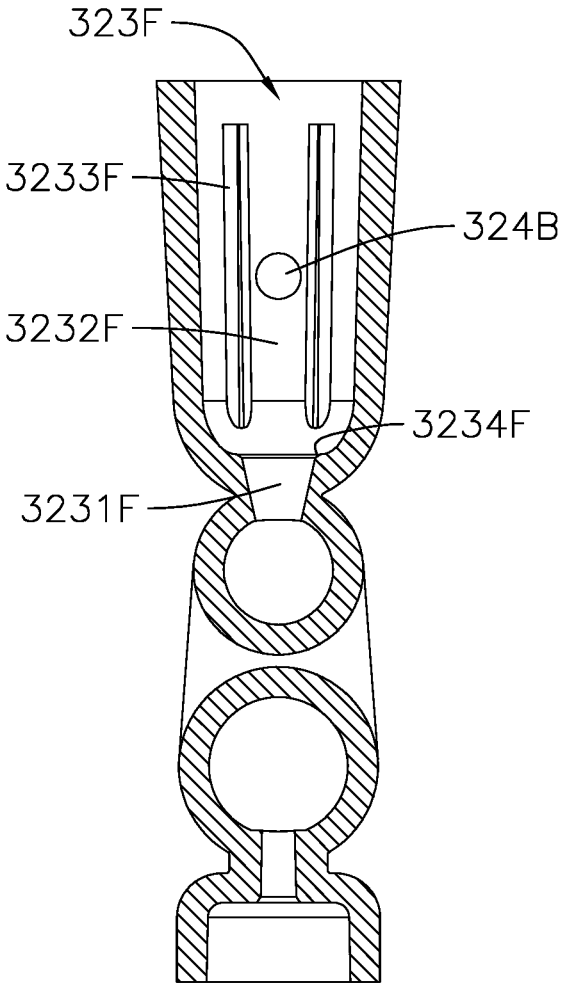
FIG. 12A is a side view in cross-section of the second embodiment of the high-pressure spray can in FIG. 10, showing the second passage.
Figure 12B:
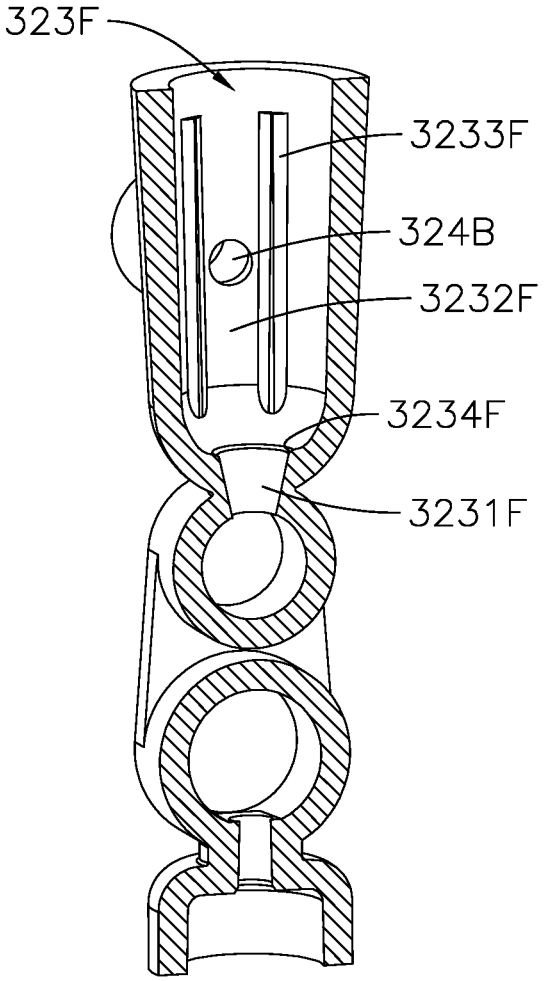
FIG. 12B is a perspective view in cross-section of the second embodiment of the high-pressure spray can in FIG. 10, showing the second passage.
Figure 13A:
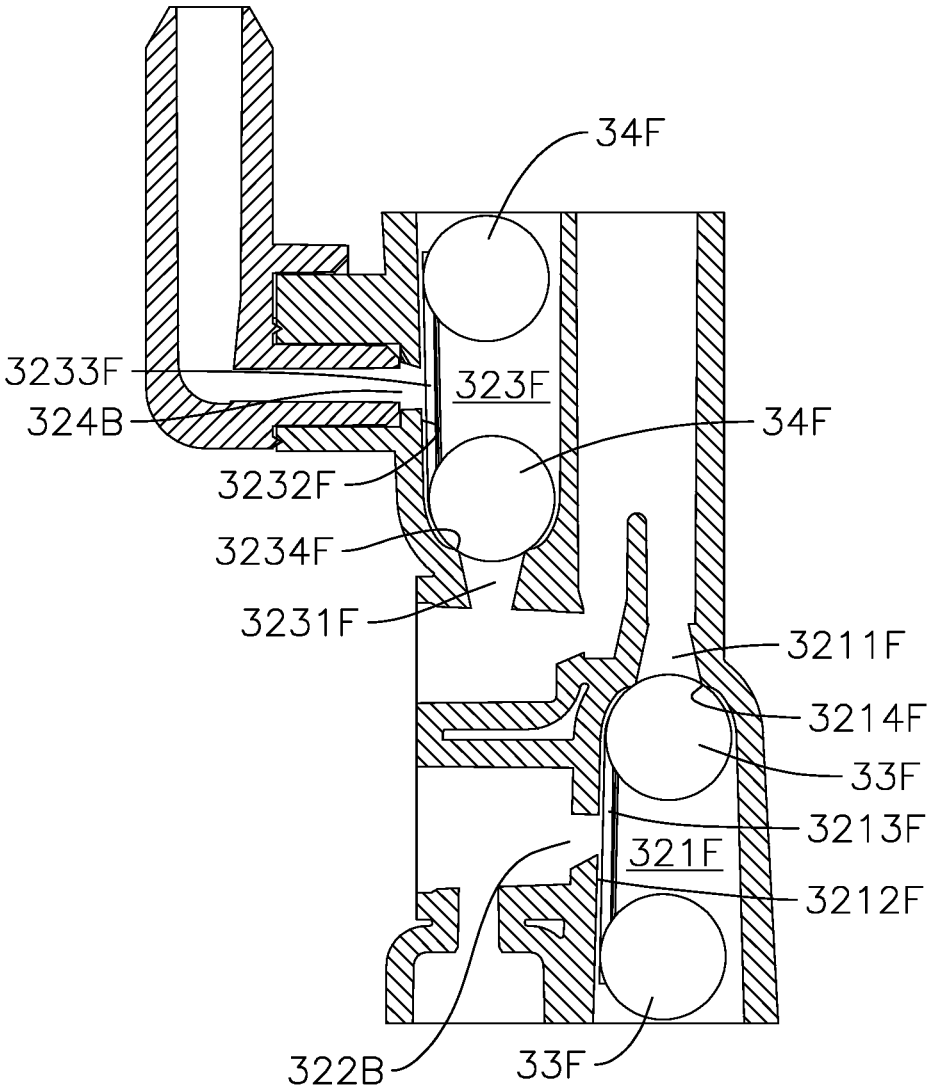
FIG. 13A is a side view in cross-section of the second embodiment of the high-pressure spray can in FIG. 10, showing the first ball and the second ball at two particular positions in the switching base.
Figure 13B:
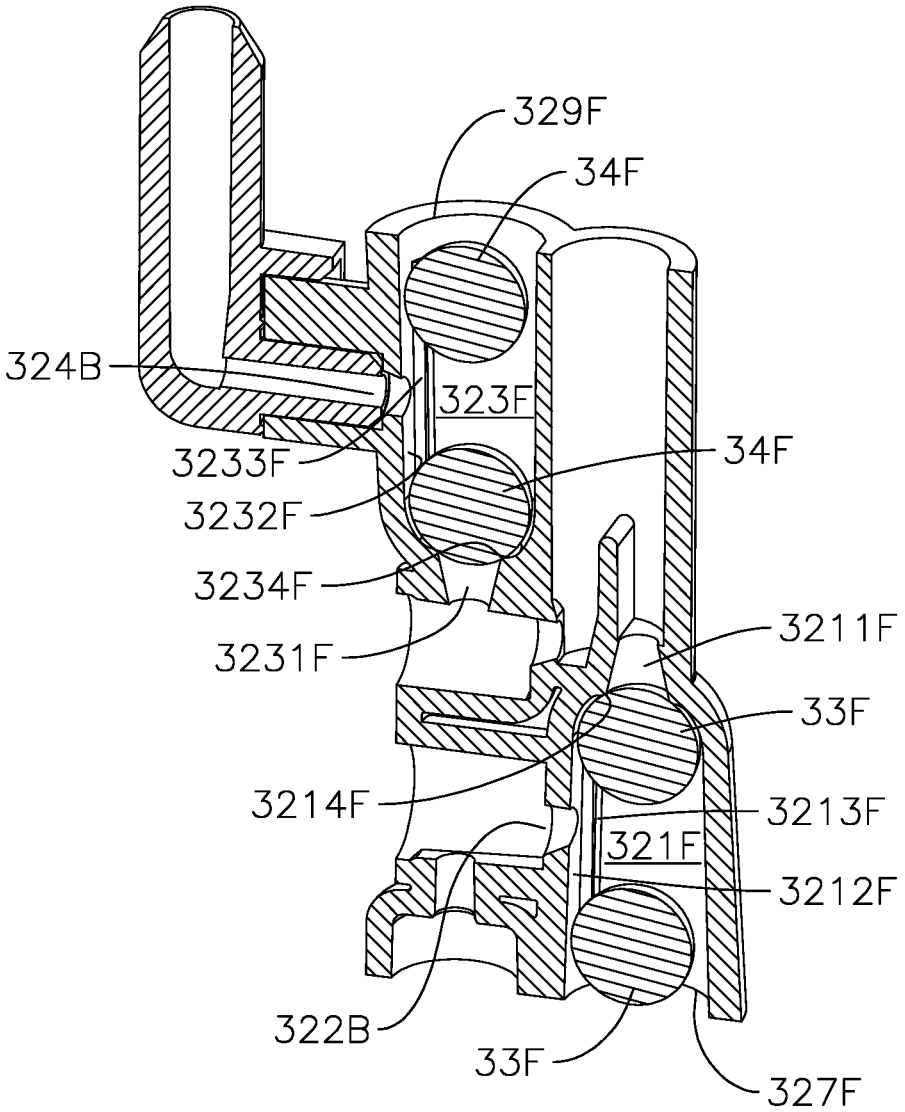
FIG. 13B is a perspective view in cross-section of the second embodiment of the high-pressure spray can in FIG. 10, showing the first ball and the second ball at two particular positions in the switching base.
Figure 14:
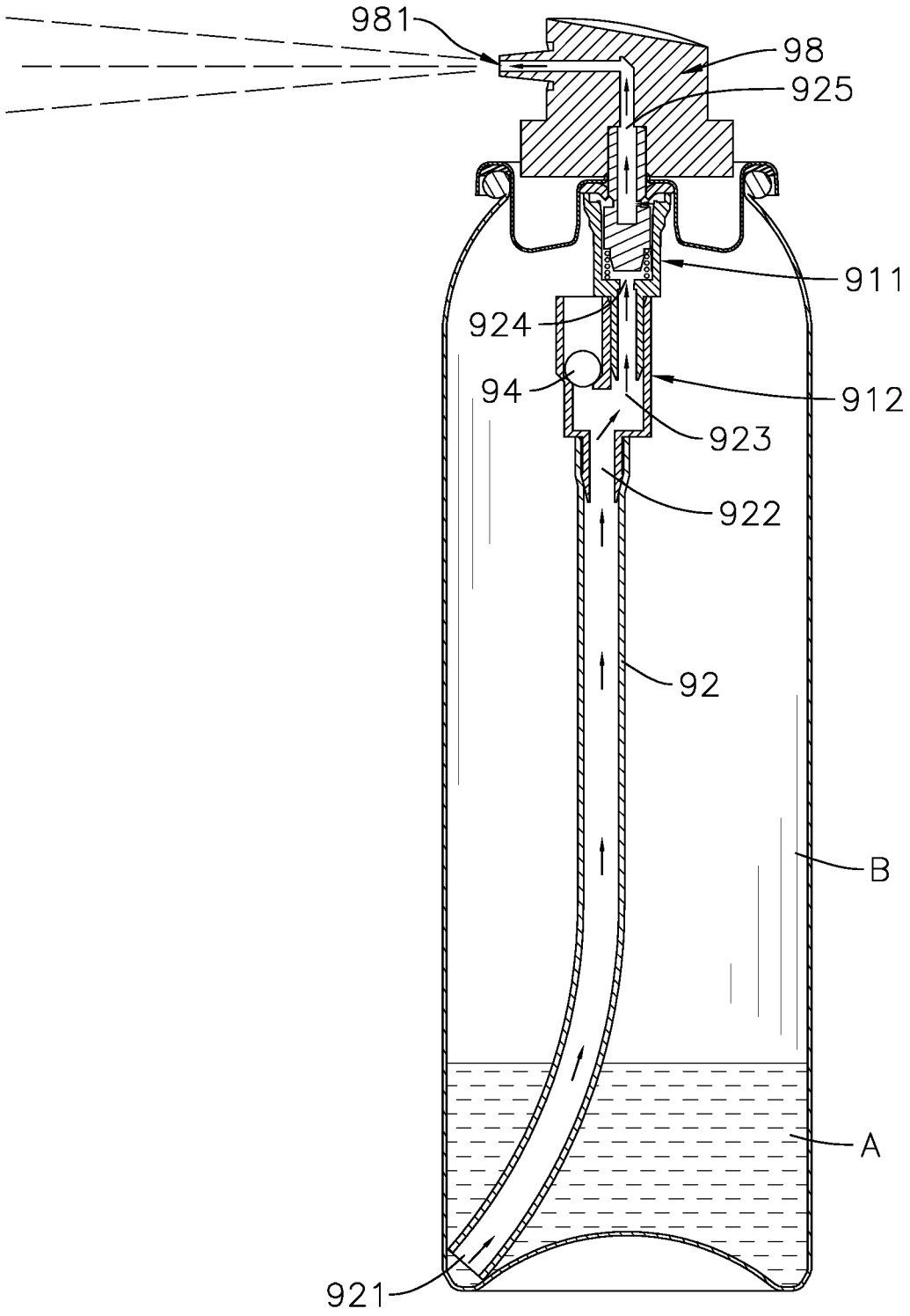
FIG.14 PRIOR ART
FIG. 14 is a side view in cross-section of a conventional high-pressure spray can, showing the high-pressure spray can placed upright to spray.
Figure 15:
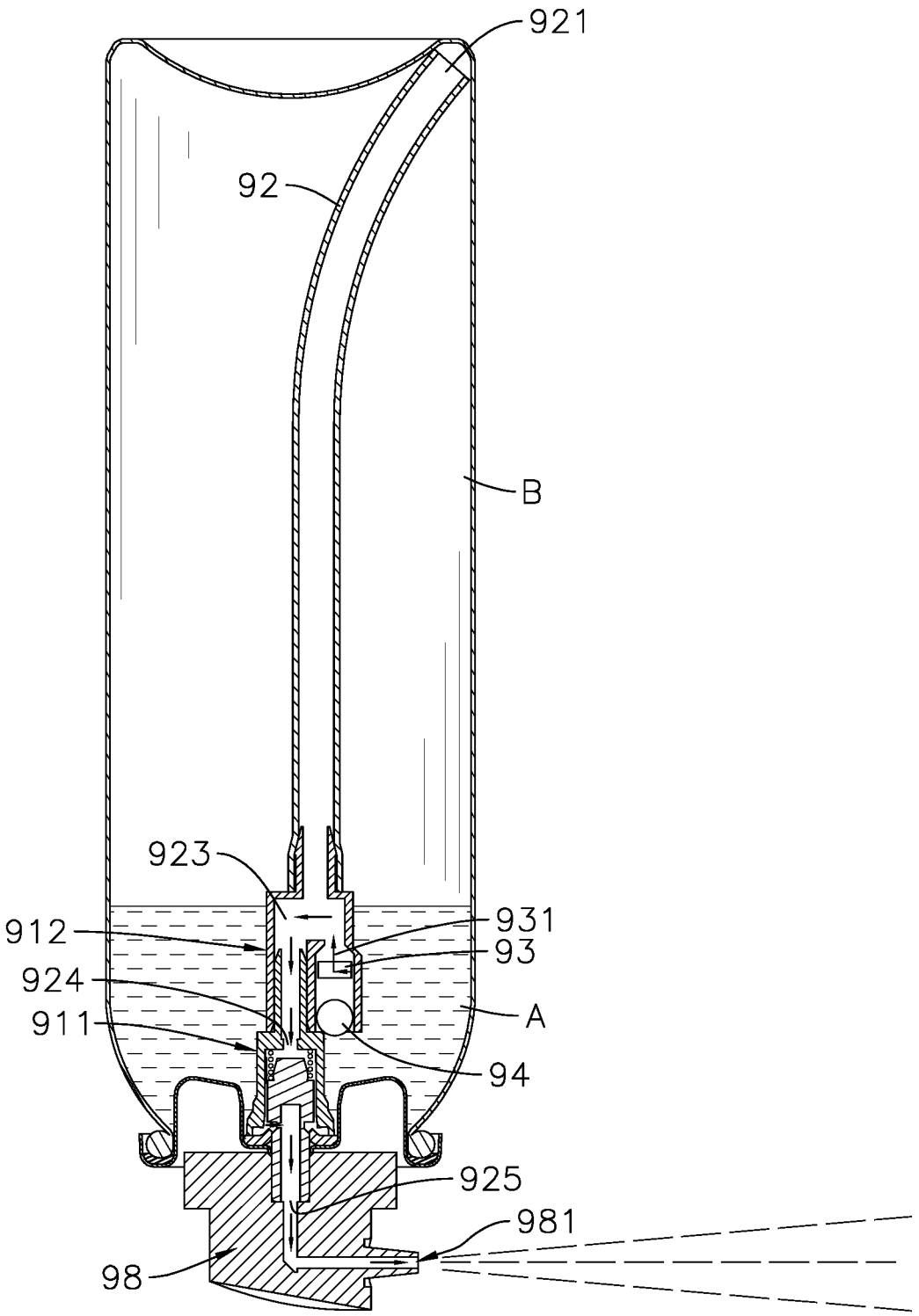
FIG.15 PRIOR ART
FIG. 15 is a side view in cross-section of a conventional high-pressure spray can, showing the high-pressure spray can placed upside down to spray.
Figure 16:
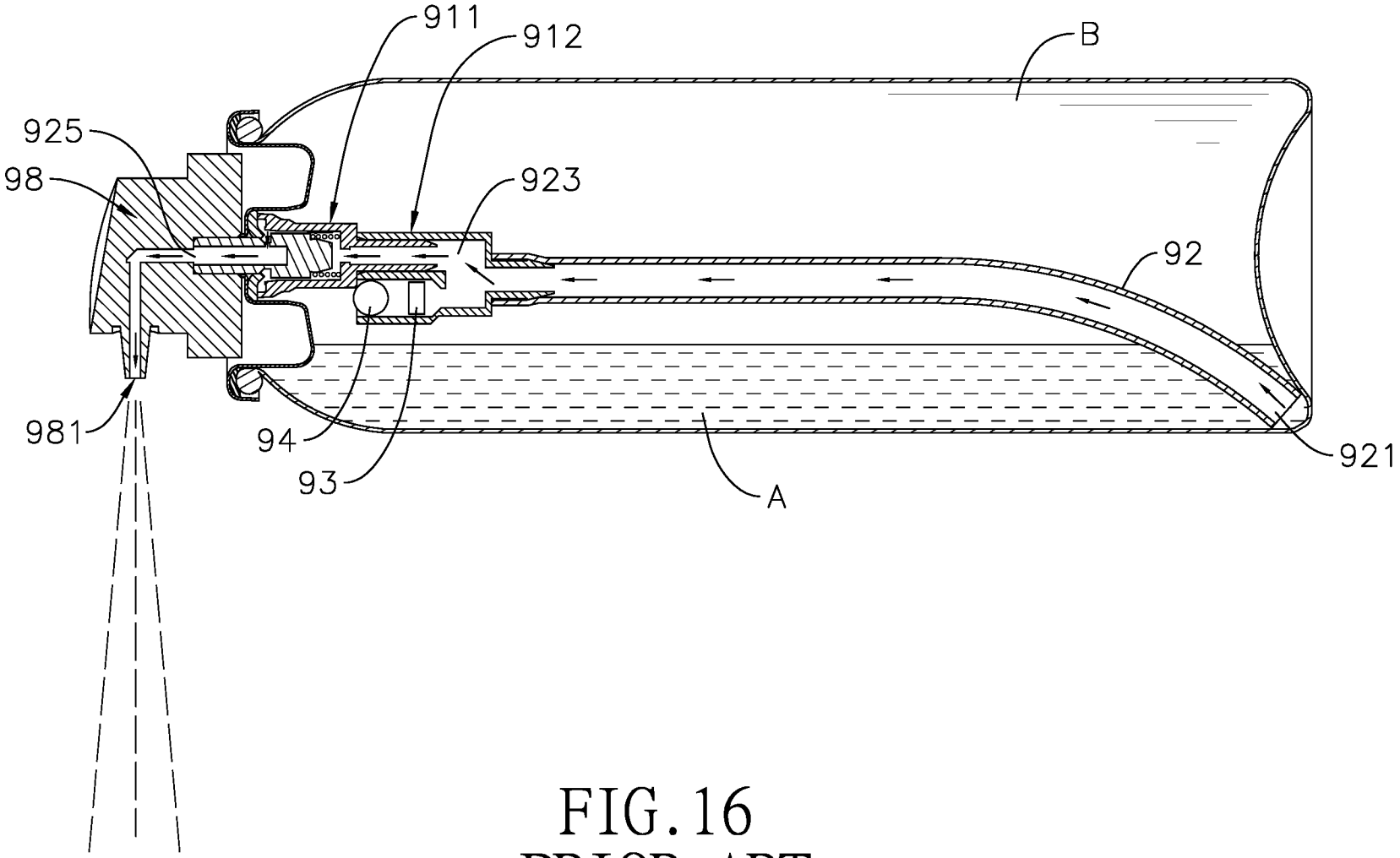
FIG. 16 PRIOR ART
FIG. 16 is a side view in cross-section of a conventional high-pressure spray can, showing the high-pressure spray can placed horizontally to spray.
Figure 17:
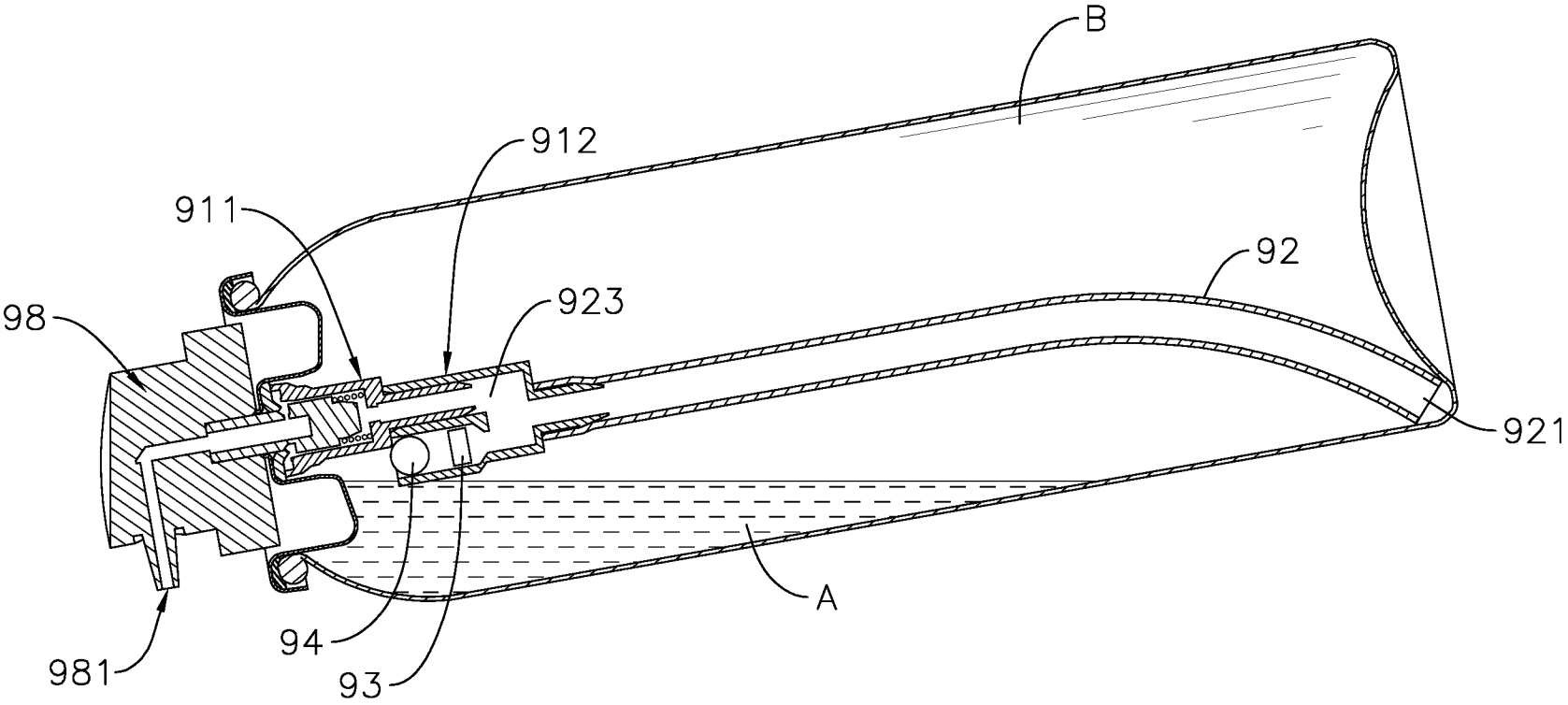
FIG. 17 PRIOR ART
FIG. 17 is a side view in cross-section of a conventional high-pressure spray can, showing the high-pressure spray can with the actuator inclined downward to spray.

With reference to FIGS. 1, 3, and 9A, the aforementioned switching base 32 has a main body 32A. The main body 32A has a first passage 321, a first suction port 322B, a second passage 323, a second suction port 324B, a common passage 325, a partition wall 326, a first opening 327, a first plug cover 328, a second opening 329, a second plug cover 330, a third opening 32B, a third plug cover 32C, a fourth opening 32D, a fourth plug cover 32E, an inverted-spraying extending tube 36A, and an upright-spraying extending tube 35A. Wherein, the first passage 321, the first suction port 322B, the second passage 323, the second suction port 324B, the common passage 325, the partition wall 326, the first opening 327, the second opening 329, the third opening 32B, the fourth opening 32D, and the inverted-spraying extending tube 36A are all formed on the main body 32A, while the first plug cover 328, the second plug cover 330, the third plug cover 32C, the fourth plug cover 32E, and the upright-spraying extending tube 35A are independent components from the main body 32A.

Figure 6:
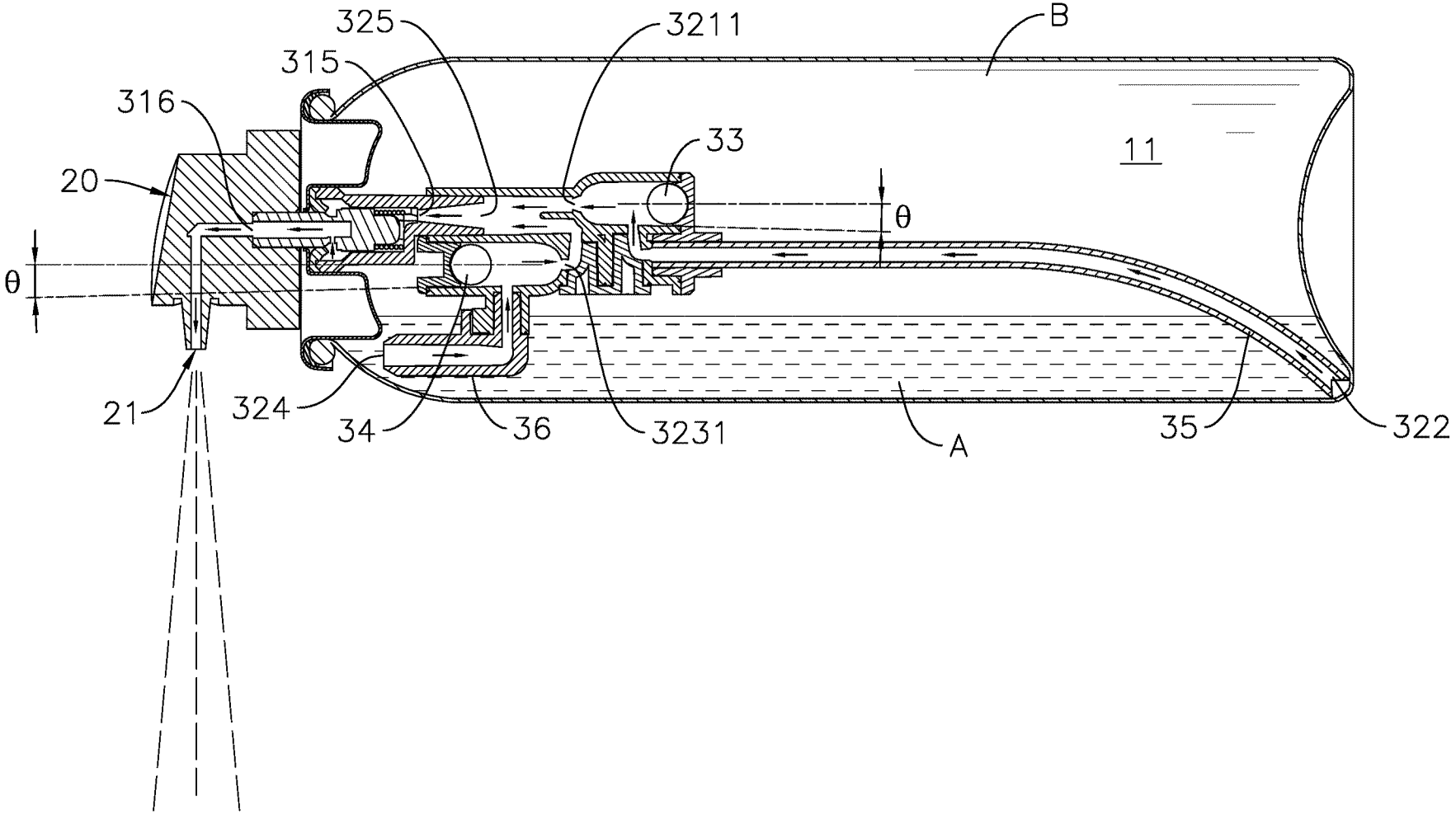
FIG. 6 is a side view in cross-section of a first embodiment of the high-pressure spray can in FIG. 1, showing the high-pressure spray can placed horizontally to spray.

With reference to FIGS. 2, 3, and 6, the top end of the switching base 32 is mounted on the bottom end of the valve assembly 31, and the switching base 32 links the flow with the valve assembly 31. The switching base 32 has the first passage 321 and the second passage 323.

With reference to FIGS. 2 and 3 and on main body 32A, the first passage 321 has a first end 3213, a second end 3214, a first linking opening 3211 and the aforementioned first inclined inner wall surface 3212. The first end 3213 of the first passage 321 points toward the first reference direction D1. The second end 3214 of the first passage 321 points toward the third reference direction D3. The first linking opening 3211 is formed on the first end 3213 of the first passage 321 pointing toward the first reference direction D1 and links the flow with the liquid product inlet 315. The first inclined inner wall surface 3212 is located in a side of the first passage 321 facing toward the second reference direction D2. The first inclined inner wall surface 3212 is inclined with respect to the axis of the can body 10. The first inclined inner wall surface 3212 extends obliquely from the first end 3213 of the first passage 321 to the second end 3214 of the first passage 321. In other words, in FIG. 3, the first inclined inner wall surface 3212 is located in the left side of the first passage 321, is inclined to the axis of the can body 10 with a gradient to left from top to bottom. With reference to FIG. 6, since the first inclined inner wall surface 3212 is formed on the side of the first passage 321 facing toward the second reference direction D2, when the can body 10 is placed horizontally, the first inclined inner wall surface 3212 is inclined downward toward the bottom of the can body 10 and forms an angle with the horizontal line. Specifically, in the first embodiment, the angle θ formed between the first inclined inner wall surface 3212 and the first reference direction D1 is 1 to 3 degrees and is preferably but not limited to 1.5 degrees.

With reference to FIG. 3, the first suction port 322B is formed on the bottom of the main body 32A, links the flow with the first passage 321, and links the flow with the liquid product inlet 315 via the first linking opening 3211 of the first passage 321.

With reference to FIG. 3, the upright-spraying extending tube 35A is formed on the main body 32A which links the flow with the first suction port 322B and extends toward the third reference direction D3. The upright-spraying dip tube 35 is assembled with the upright-spraying extending tube 35A.

With reference to FIGS. 2 and 3 and on main body 32A, the second passage 323 has a first end 3233, a second end 3234, a second linking opening 3231 and the aforementioned second inclined inner wall surface 3232. The second linking opening 3231 is formed on the first end 3233 of the second passage 323 and links the flow with the liquid product inlet 315. The second inclined inner wall surface 3232 is located in a side of the second passage 323 facing toward the second reference direction D2. The second inclined inner wall surface 3232 is inclined with respect to the axis of the can body 10. The second inclined inner wall surface 3232 extends obliquely from the first end 3233 of the second passage 323 to the second end 3234 of the second passage 323 and leans toward the second reference direction D2. In other words, in FIG. 3, the second inclined inner wall surface 3232 is located in the left side of the second passage 323, is inclined with respect to the axis of the can body 10 with a gradient to left from bottom to top. With reference to FIG. 6, since the second inclined inner wall surface 3232 is formed on one side of the second passage 323 facing toward the second reference direction D2, when the can body 10 is placed horizontally, the second inclined inner wall surface 3232 is inclined downward toward the top of the can body 10 and forms an angle with the horizontal line. Specifically, in the first embodiment, the angle θ formed between the second inclined inner wall surface 3232 and the third reference direction D3 is 1 to 3 degrees and is preferably but not limited to 1.5 degrees. The inclined degree of the second inclined inner wall surface 3232 can be different from the inclined degree of the first inclined inner wall surface 3212.

With reference to FIG. 3 and FIGS. 9A, in the first embodiment, the switching base 32 has an inverted-spraying extending tube 36A directly formed on the main body 32A. The inverted-spraying extending tube 36A extends along the second reference direction D2 to an inner wall of the can body 10. The second suction port 324B is formed on an end of the inverted-spraying extending tube 36A pointing toward the second reference direction D2, which means the second suction port 324B is an end hole formed on the inverted-spraying extending tube 36A and links the flow with the second passage 323, and links the flow with the liquid product inlet 315 via the second linking opening 3231 of the second passage 323. Additionally, a retaining rib 363 is formed on the inverted-spraying extending tube 36A.

With reference to FIGS. 1, 3, 9A, and 9B, the inverted-spraying dip tube 36 forms a retaining groove 361 and a connecting end 362. The retaining groove 361 is used to engage with the retaining rib 363 of the inverted-spraying extending tube 36A to fix the position of the inverted-spraying dip tube 36 and the inverted-spraying extending tube 36A. The connecting end 362 links the flow with the second suction port 324B and the second linking opening 3231. Specifically, when the inverted-spraying dip tube 36 engages with the inverted-spraying extending tube 36A, the connecting end 362 is mounted in the inverted-spraying extending tube 36A. Since the connecting end 362 and the inverted-spraying extending tube 36A are two round tubes, the retaining groove 361 is configured to engage with the retaining rib 363 when the inverted-spraying dip tube 36 and the inverted-spraying extending tube 36A are assembled to make the L-shaped inverted-spraying dip tube 36 with an opening pointing upward.

With reference to FIG. 3 on main body 32A, the common passage 325 links the flow with the liquid product inlet 315, and the first linking opening 3211 and the second linking opening 3231 are linking the flow with the liquid product inlet 315 via the common passage 325. The partition wall 326 is formed in the common passage 325 and is located between the first linking opening 3211 and the second linking opening 3231. The partition wall 326 and the common passage 325 are configured to stabilize the flow when the liquid product A enters from both the first suction port 322B and the second suction port 324B at the same time, thereby preventing two flows of the liquid product A from impacting each other and generating turbulence that affects spraying. But in other embodiments, the present invention can also be implemented without the common passage 325 and the partition wall 326.

With reference to FIGS. 2 and 3 on main body 32A, the first opening 327 is formed on the second end 3214 of the first passage 321 facing the third reference direction D3, and the first ball 33 can be placed in or removed from the first passage 321 via the first opening 327. The first plug cover 328 detachably seals the first opening 327 to support and prevent the first ball 33 from falling out of the first passage 321. The second opening 329 is formed on the second end 3234 of the second passage 323 facing toward the first reference direction D1, and the second ball 34 can enter or be removed from the second passage 323 via the second opening 329. The second plug cover 330 detachably seals the second opening 329 to support and prevent the second ball 34 from falling out of the second passage 323. The first ball 33 and the second ball 34 are preferably made of stainless steel.

With reference to FIGS. 3 and 9A on main body 32A, the third opening 32B is formed on a side of the main body 32A facing toward the second reference direction D2 and is linking the flow with the first linking opening 3211. The third plug cover 32C detachably seals the third opening 32B and has a third-plug-cover-guiding wall 32C1. When the third plug cover 32C seals the third opening 32B, the third-plug-cover-guiding wall 32C1 forms a complementary first curved connecting passage with the main body 32A, and the first curved connecting passage is connected between the first suction port 322B and the first passage 321. The fourth opening 32D is formed on one side of the main body 32A facing toward the second reference direction D2 and is linking the flow with the second linking opening 3231. The fourth plug cover 32E detachably seals the fourth opening 32D and has a fourth-plug-cover-guiding wall 32E1. When the fourth plug cover 32E seals the fourth opening 32D, the fourth-plug-cover-guiding wall 32E1 forms a complementary second curved connecting passage with the main body 32A, and the second curved connecting passage is connected between the second linking opening 3231 and the common passage 325. In other words, the third opening 32B is formed between a top end of the first suction port 322B and the first passage 321, and the fourth opening 32D is formed between the second linking opening 3231 and the common passage 325. The third plug cover 32C and the fourth plug cover 32E are distant from each other but connected to each other. The third plug cover 32C detachably seals the third opening 32B to form the first curved connecting passage between the top end of the first suction port 322B and the first passage 321 for configuring a curved passage. The fourth plug cover 32E detachably seals the second curved connecting passage between the second linking opening 3231 and the common passage 325 for configuring a curved passage.

Additionally, with reference to FIG. 1, in the first embodiment, the upright-spraying extending tube 35A and the first plug cover 328 are distant from each other and are connected to each other, but it is not limited thereto in other embodiments.

Figure 4:
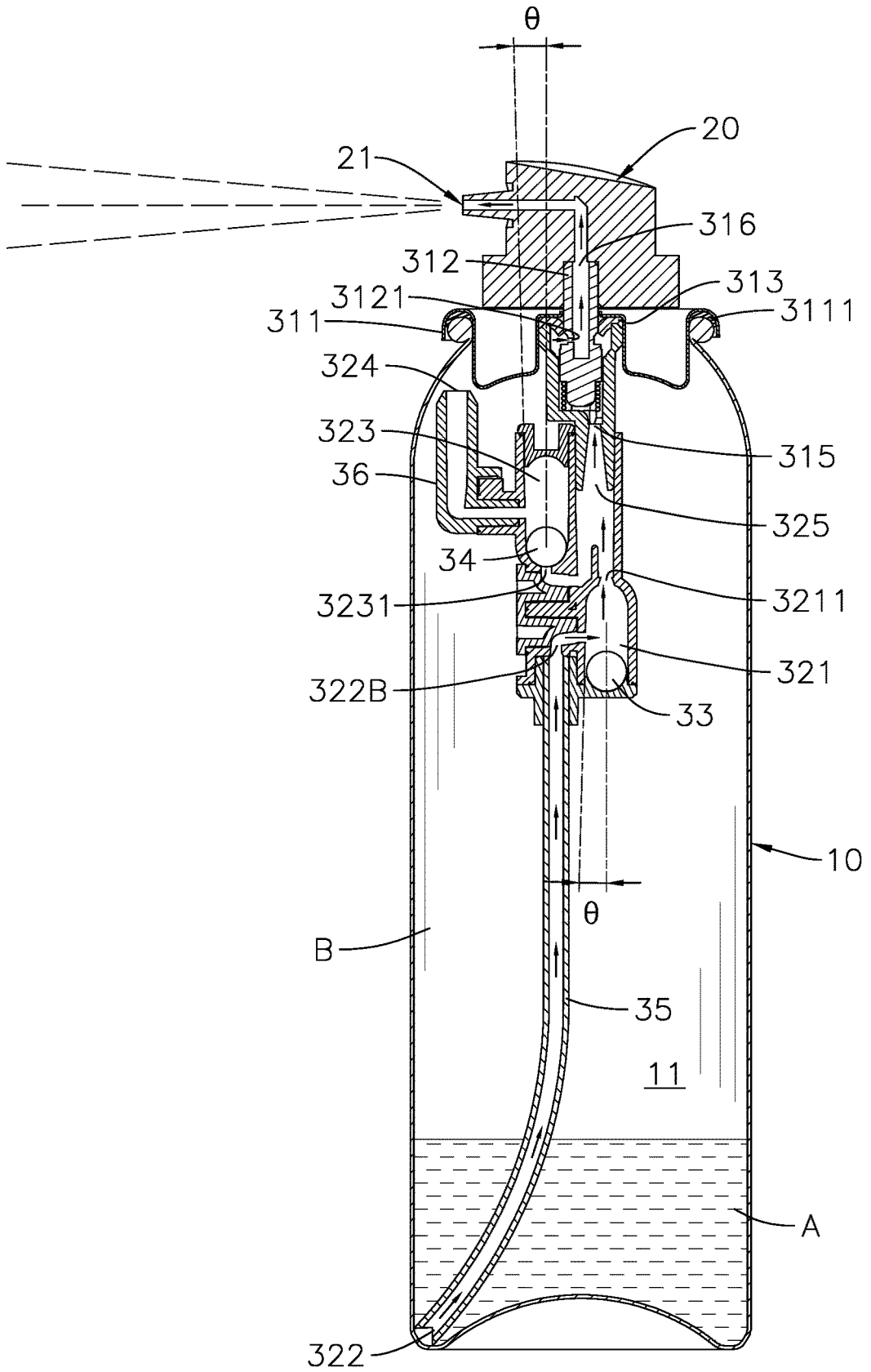
FIG. 4 is a side view in cross-section of a first embodiment of the high-pressure spray can in FIG. 1, showing the high-pressure spray can placed upright to spray.

For clearer explanation, with reference to FIGS. 1, 3, and 4, the main body 32A is a part of the switching base 32 as described above. Therefore, before the main body 32A is assembled with the upright-spraying dip tube 35 and the inverted-spraying dip tube 36, two suction ports on the main body 32A are defined as the first suction port 322B and the second suction port 324B. On the contrary, after the main body 32A is assembled with the upright-spraying dip tube 35 and the inverted-spraying dip tube 36, which means the high-pressure spray can is in use, the inlet opening of the upright-spraying dip tube 35 away from the main body 32A is defined as the upright-spraying suction port 322, and the inlet opening of the L-shaped inverted-spraying dip tube 36 away from the main body 32A is defined as the inverted-spraying suction port 324.

Figure 5:
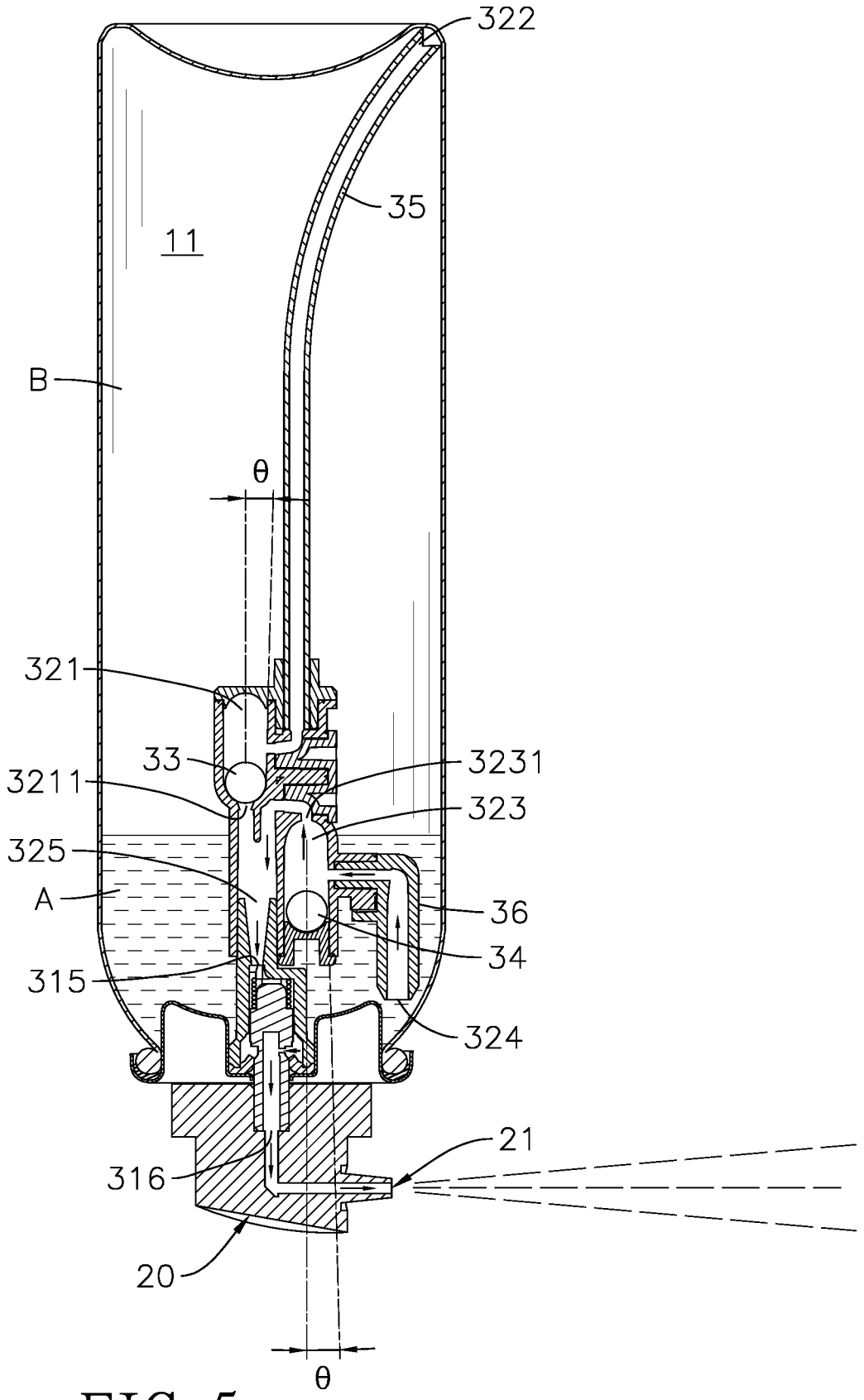
FIG. 5 is a side view in cross-section of a first embodiment of the high-pressure spray can in FIG. 1, showing the high-pressure spray can placed upside down to spray.

With reference to FIG. 3, in the first embodiment, the first ball 33 is movably mounted in the first passage 321 and selectively links or blocks between the upright-spraying suction port 322 and the liquid product inlet 315. The second ball 34 is movably mounted in the second passage 323 and selectively links or blocks between the inverted-spraying suction port 324 and the liquid product inlet 315. With reference to FIG. 4, when the high-pressure spray can is placed upright to spray, the upright-spraying suction port 322 of the upright-spraying dip tube 35 is immersed in the liquid product A, and the first ball 33 is driven by the gravity and slides down to the first plug cover 328 such that the upright-spraying suction port 322 is linking the flow with the liquid product inlet 315 via the first linking opening 3211. At the same time, the second ball 34 is also driven by the gravity and slides down to block the second linking opening 3231 such that the inverted-spraying suction port 324 and the liquid product inlet 315 are blocked. With reference to FIG. 5, when the high-pressure spray can is placed upside down to spray, the inverted-spraying suction port 324 of the inverted-spraying dip tube 36 is immersed in the liquid product A, and the second ball 34 is driven by the gravity and slides down to the second plug cover 330 such that the inverted-spraying suction port 324 is linking the flow with the liquid product inlet 315 via the second linking opening 3231. At the same time, the first ball 33 is also driven by the gravity and slides down to block the first linking opening 3211 such that the upright-spraying suction port 322 and the liquid product inlet 315 are blocked. With reference to FIG. 6, when the high-pressure spray can is placed horizontally to spray, the upright-spraying suction port 322 of the upright-spraying dip tube 35 is immersed in the liquid product A, and the inverted-spraying suction port 324 of the inverted-spraying dip tube 36 is immersed in the liquid product A. At the same time, the first ball 33 is driven by the gravity to abut the first inclined inner wall surface 3212 and slide down toward the bottom end of the can body 10, and then the first ball 33 stops in the lower end of the first inclined inner wall surface 3212 such that the upright-spraying suction port 322 is linking the flow with the liquid product inlet 315 via the first linking opening 3211. Further, the second ball 34 is also driven by the gravity to abut the second inclined inner wall surface 3232 and slide down toward the top end of the can body 10, and then the second ball 34 stops in the lower end of the second inclined inner wall surface 3232 such that the inverted-spraying suction port 324 is linking the flow with the liquid product inlet 315 via the second linking opening 3231.

With reference to FIGS. 3, 4, and 9A, in the first embodiment, on the main body 32A, the top end of the upright-spraying dip tube 35 is connected to the first suction port 322B of the main body 32A via the upright-spraying extending tube 35A and is linking the flow with the first linking opening 3211. The upright-spraying dip tube 35 is curved toward the same side to which the nozzle 21 of the actuator 20 points. The upright-spraying suction port 322 of the upright-spraying dip tube 35 extends in the third reference direction D3 to the corner where the can wall and the can bottom are connected. Thus, the upright-spraying suction port 322 of the upright-spraying dip tube 35 can be immersed and located in the liquid product A when the high-pressure spray can is placed upright to spray. With reference to FIGS. 1, 3, 5 and 9A, in the first embodiment, the inverted-spraying dip tube 36 is L-shaped. The connecting end 362 of the inverted-spraying dip tube 36 is connected to the second suction port 324B of the main body 32A and is linking the flow with the second linking opening 3231. The inverted-spraying suction port 324 of the inverted-spraying dip tube 36 extends in firstly the second reference direction D2 then secondly the first reference direction D1 to the top end of the can body 10. Thus, the inverted-spraying suction port 324 of the inverted-spraying dip tube 36 can be immersed and located in the liquid product A when the high-pressure spray can is placed upside down to spray. But the structure above is not limited thereto, as the upright-spraying suction port 322 of the upright-spraying dip tube 35 can also extend straight along the third reference direction D3, and the inverted-spraying suction port 324 of the inverted-spraying dip tube 36 can also extend only along the second reference direction D2 without extending upward.

More specifically, there are five conditions of the high-pressure spray can in use as described below:

First, the high-pressure spray can is placed upright to spray. With reference to FIG. 4, when the high-pressure spray can is placed upright to spray, the first ball 33 is located at the lower end of the first passage 321 and makes the first linking opening 3211 linking the flow with the liquid product inlet 315. At this time, the second ball 34 also slides down to the lower end of the second passage 323 and blocks the second linking opening 3231 such that the inverted-spraying suction port 324 and the liquid product inlet 315 are blocked. At this time, the upright-spraying suction port 322 is immersed in the liquid product A while the inverted-spraying suction port 324 is exposed in the propellant B. Therefore, after the actuator 20 is pressed, the liquid product A sequentially passes through the upright-spraying suction port 322, the first passage 321, the first linking opening 3211, and the common passage 325, then enters the liquid product inlet 315, and finally is sprayed out. At this time, since the second ball 34 blocks the inverted-spraying suction port 324 and the liquid product inlet 315, even if the inverted-spraying suction port 324 of the inverted-spraying dip tube 36 is exposed in the propellant B, the propellant B will not leak out through the nozzle 21.

Second, the high-pressure spray can is placed upside down to spray. With reference to FIG. 5, when the high-pressure spray can is placed upside down to spray, the second ball 34 is located at the lower end of the second passage 323 and makes the inverted-spraying suction port 324 linking the flow with the liquid product inlet 315 via the second linking opening 3231. At this time, the first ball 33 also slides down to the lower end of the first passage 321 and blocks the first linking opening 3211 such that the upright-spraying suction port 322 and the liquid product inlet 315 are blocked. At this time, the inverted-spraying suction port 324 is immersed in the liquid product A while the upright-spraying suction port 322 is exposed in the propellant B. Therefore, after the actuator 20 is pressed, the liquid product A sequentially passes through the inverted-spraying suction port 324, the second passage 323, the second linking opening 3231, and the common passage 325, then enters the liquid product inlet 315, and finally is sprayed out. At this time, since the first ball 33 blocks the upright-spraying suction port 322 and the liquid product inlet 315, even if the upright-spraying suction port 322 of the upright-spraying dip tube 35 is exposed in the propellant B, the propellant B will not leak out through the nozzle 21.

Third, the high-pressure spray can is placed horizontally to spray. With reference to FIG. 6, when the high-pressure spray can is placed horizontally to spray, the first inclined inner wall surface 3212 forms an angle with the horizontal line, and the first inclined inner wall surface 3212 is inclined downward and extends toward the bottom end of the can body 10, and the angle θ between the first inclined inner wall surface 3212 and the horizontal line is 1.5 degrees. The second inclined inner wall surface 3232 forms an angle with the horizontal line, the second inclined inner wall surface 3232 is inclined downward and extends toward the top end of the can body 10, and the angle θ between the second inclined inner wall surface 3232 and the horizontal line is 1.5 degrees. Therefore, when the remaining volume of liquid product A is equal to or less than a half and the can body 10 is in horizontal condition, since the first inclined inner wall surface 3212 and the second inclined inner wall surface 3232 are inclined downward, the first ball 33 abuts the first inclined inner wall surface 3212 and quickly slides down toward the bottom end of the can body 10 and then stops at the lower end of the first inclined inner wall surface 3212, which makes the upright-spraying suction port 322 linking the flow with the liquid product inlet 315. At the same time, the second ball 34 abuts the second inclined inner wall surface 3232 and quickly slides down toward the top end of the can body 10 and then stops at the lower end of the second inclined inner wall surface 3232, which makes the inverted-spraying suction port 324 linking the flow with the liquid product inlet 315. In other words, when the can body 10 is in horizontal condition because of the configuration the first inclined inner wall surface 3212 and the second inclined inner wall surface 3232, the first ball 33 and the second ball 34 will move in a co-motion manner with each other to slide down to the inclined lower ends at the same time and make both the upright-spraying suction port 322 and the inverted-spraying suction port 324 open. Thus, the liquid product A will enter the two suction ports and sequentially pass through the two passages, the two linking openings, and the common passage 325, and then enter the liquid product inlet 315, and finally is sprayed out. As a result, the liquid product A and the propellant B in the can body 10 will be used up without any waste.

Figure 7:
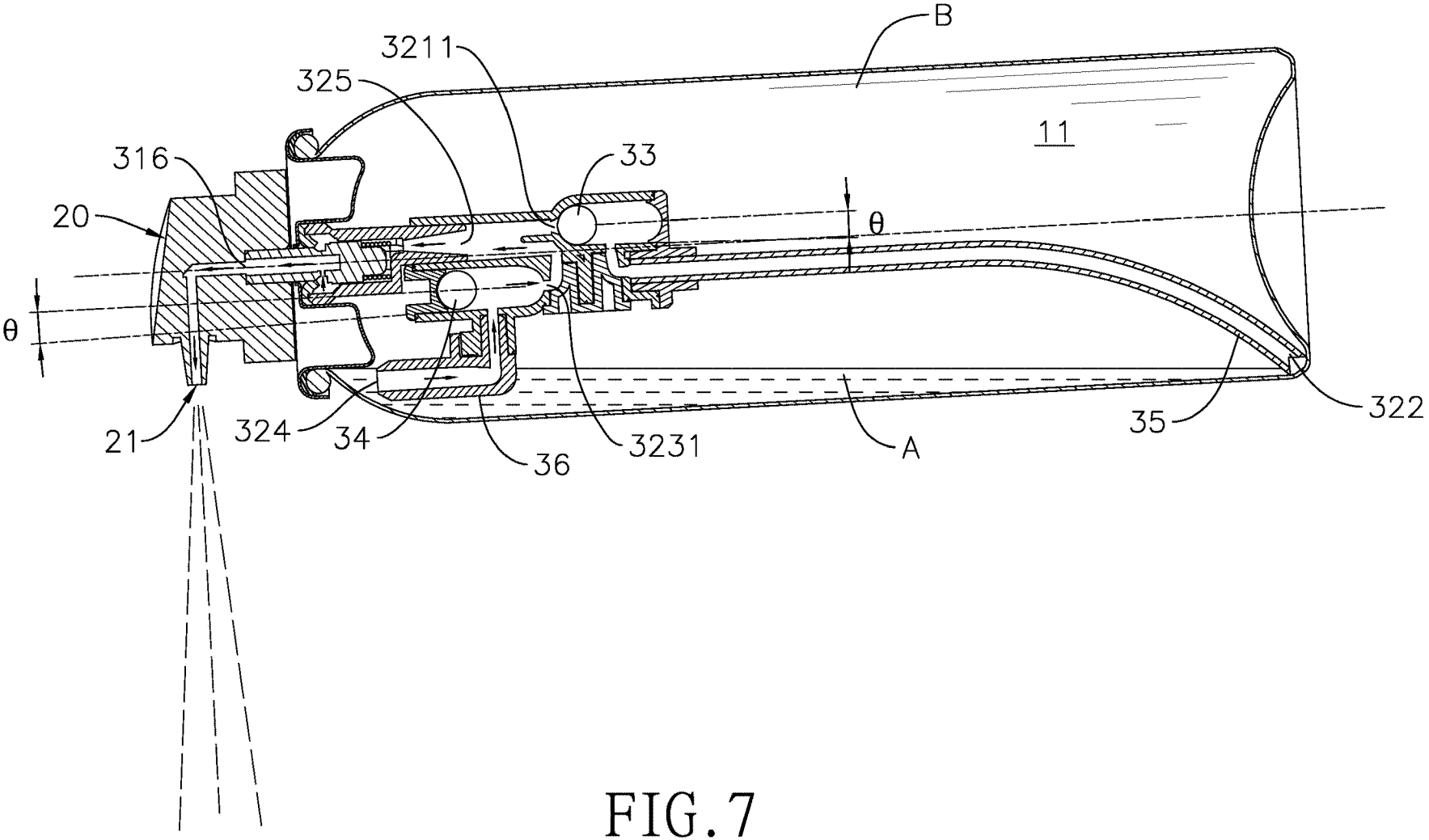
FIG. 7 is a side view in cross-section of a first embodiment of the high-pressure spray can in FIG. 1, showing the high-pressure spray can in horizontal condition with the actuator inclined downward to spray.

Fourth, the can body 10 is placed at a horizontal condition with the actuator 20 facing continuously downward. With reference to FIG. 7, the second inclined inner wall surface 3232 inclined downward and extends toward the top end of the can body 10. The angle θ between the second inclined inner wall surface 3232 and the horizontal line is 1.5 degrees. When the remaining liquid product A is equal to or less than a half and meanwhile the second ball 34 is abutting the second inclined inner wall surface 3232, the second ball 34 quickly slides down and stops at the lower end of the second inclined inner wall surface 3232 to make the inverted-spraying suction port 324 link the flow with the liquid product inlet 315, wherein the inverted-spraying suction port 324 is immersed in the liquid product A at this moment. Besides, the first ball 33 slides toward the top end of the can body 10 to block the first linking opening 3211 such that the upright-spraying suction port 322 and the liquid product inlet 315 are blocked, wherein the inverted-spraying suction port 324 is immersed in the liquid product A while the upright-spraying suction port 322 is exposed in the propellent B at this moment. Therefore, after the actuator 20 is pressed, the liquid product A sequentially passes through the inverted-spraying suction port 324, the second passage 323, the second linking opening 3231, and the common passage 325, then enters the liquid product inlet 315, and finally is sprayed. Moreover, since the first ball 33 blocks the upright-spraying suction port 322 and the liquid product inlet 315, even if the upright-spraying suction port 322 is exposed in the propellant B, the propellant B will not leak from the nozzle 21 at this time.

Figure 8:
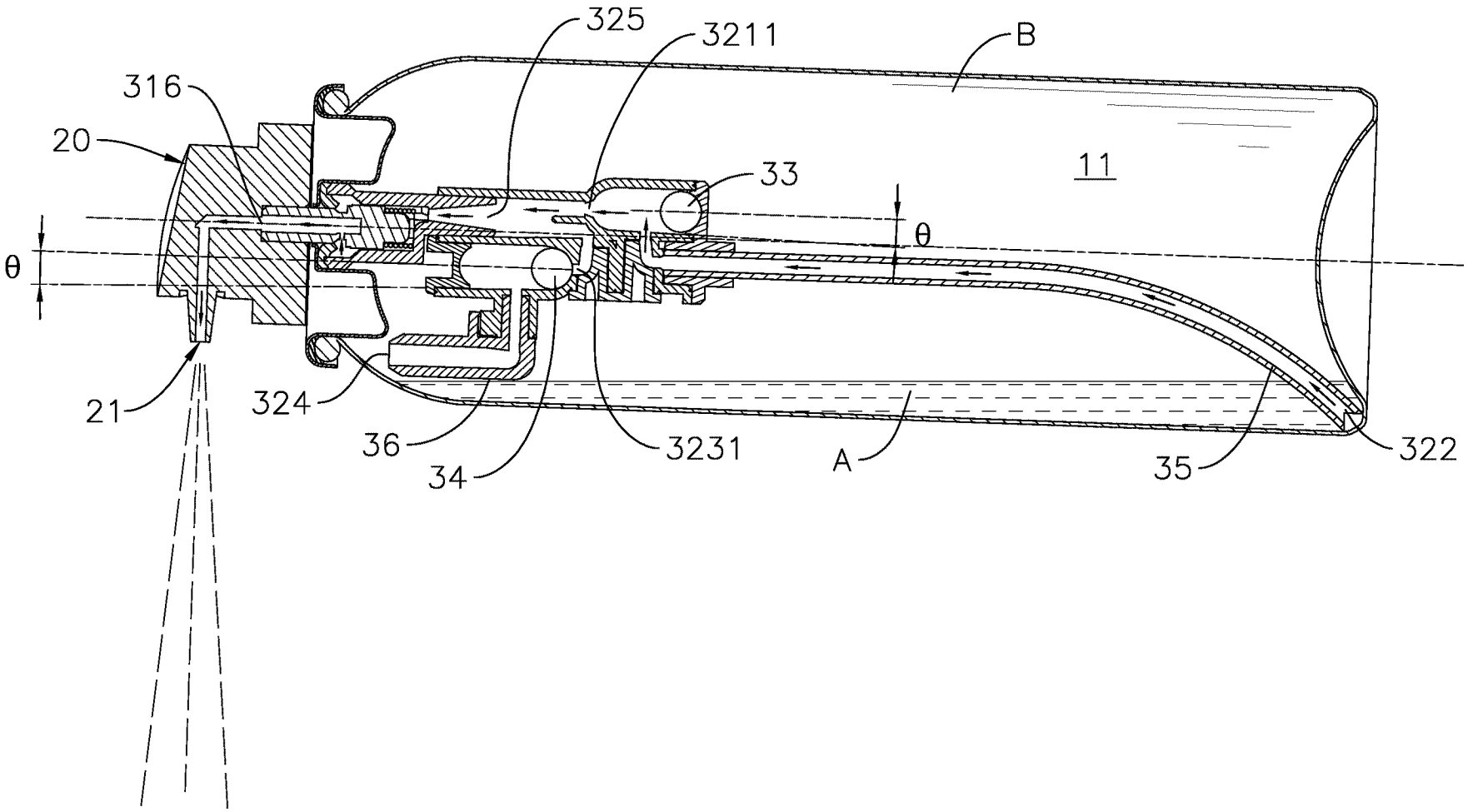
FIG. 8 is a side view in cross-section of a first embodiment of the high-pressure spray can in FIG. 1, showing the high-pressure spray can in horizontal condition with the actuator inclined upward to spray.

Fifth, the can body 10 is placed at a horizontal condition with the actuator 20 facing continuously upward. With reference to FIG. 8, the first inclined inner wall surface 3212 inclined downward and extends toward the bottom end of the can body 10. The angle θ between the first inclined inner wall surface 3212 and the horizontal line is 1.5 degrees. When the remaining liquid product A is equal to or less than a half and meanwhile the first ball 33 is abutting the first inclined inner wall surface 3212, the first ball 33 quickly slides down and stops at the lower end of the first inclined inner wall surface 3212 to make the upright-spraying suction port 322 linking the flow with the liquid product inlet 315, wherein the upright-spraying suction port 322 is immersed in the liquid product A. Besides, the second ball 34 slides toward the bottom end of the can body 10 to block the second linking opening 3231 such that the inverted-spraying suction port 324 and the liquid product inlet 315 are blocked, wherein the upright-spraying suction port 322 is immersed in the liquid product A while the inverted-spraying suction port 324 is exposed in the propellent B at this moment. Therefore, after the actuator 20 is pressed, the liquid product A sequentially passes through the upright-spraying suction port 322, the first passage 321, the first linking opening 3211, and the common passage 325, then enters the liquid product inlet 315, and finally is sprayed. Moreover, since the second ball 34 blocks the inverted-spraying suction port 324 and the liquid product inlet 315, even if the inverted-spraying suction port 324 is exposed in the propellant B, the propellant B will not leak from the nozzle 21 at this time.

In summary, though there are five operation conditions of the high-pressure spray can, but the movements and the positions of the first ball 33 and the second ball 34 only occur in three conditions, as follows:

1. For upright spray condition, the first ball 33 opens the upright-spraying suction port 322 while the second ball 34 blocks the inverted-spraying suction port 324.

2. For inverted spray condition, the second ball 34 opens the inverted-spraying suction port 324 while the first ball 33 blocks the upright-spraying suction port 322.

3. For horizontal spray condition, the first ball 33 and the second ball 34 respectively open the upright-spraying suction port 322 and inverted-spraying suction port 324 at the same time.

Moreover, when the spray can body 10 is in horizontal spray condition with the actuator 20 facing downward (as shown in FIG. 7) or upward (as shown in FIG. 8), to change specific operating angles is thus highly responsive and undisturbed. Meanwhile, the first ball 33 and the second ball 34 move and stop in co-motion at a particular angle. As a result, the present invention can shift the operating spray angles among different conditions swiftly; thus, the high-pressure spray can sprays in a smoother flow with no or minimal intermission of slurping, and the propellant B hardly leaks even if the user rotates and tilts the can body 10 when operating the high-pressure spray can.

With reference to FIGS. 10 to 13, a structure of a second embodiment of the present invention is basically the same as the structure of the first embodiment, and by incorporating the first ball 33F and the second ball 34F operating along the first inclined inner wall surface 3212F and the second inclined inner wall surface 3232F of the first passage 321F and the second passage 323F of the main body 32F of the switching base 32 to quickly switch from spraying in upright, upside down and horizontal conditions without leaking the propellant B, and the differences between the two embodiments are described as follows:

In the second embodiment, the first inclined inner wall surface 3212F has two first rib-shaped sliding tracks 3213F and the second inclined inner wall surface 3232F has two second rib-shaped sliding tracks 3233F. The two first rib-shaped sliding tracks 3213F extend along the first inclined inner wall surface 3212F, are spaced apart from each other, and are adjacent to two sides of the first suction port 322B. The first ball 33F movably abuts the two first rib-shaped sliding tracks 3213F such that a gap is formed between the first ball 33F and the first inclined inner wall surface 3212F. The two second rib-shaped sliding tracks 3233F extend along the second inclined inner wall surface 3232F, are spaced apart from each other, and are adjacent to two sides of the second suction port 324B. The second ball 34F movably abuts the two second rib-shaped sliding tracks 3233F such that a gap is formed between the second ball 34F and the second inclined inner wall surface 3232F.

Additionally, an inner diameter of the first passage 321F is larger than a diameter of the first ball 33F, and an inner diameter of the second passage 323F is larger than a diameter of the second ball 34F. Therefore, when the first ball 33F and the second ball 34F are respectively rolling in the first passage 321F and the second passage 323F, there are gaps formed respectively between the first ball 33F and the first passage 321F and between the second ball 34F and the second passage 323F, which prevents the rolling resistance of the first ball 33F and the second ball 34F in the first passage 321F and the second passage 323F due to the adherence of liquid product A to surfaces of the first ball 33F and the second ball 34F, so that the first ball 33F and the second ball 34F shift between different spraying conditions more swiftly and accurately.

Further, on the section perpendicular to the first reference direction D1, the two first rib-shaped sliding tracks 3213F and the two second rib-shaped sliding tracks 3233F have a section of an arched or a polygonal shape.

With reference to FIGS. 10 to 13, in the second embodiment, a first plug cover 328F of the main body 32F of the switching base 32 is detachably mounted on the first opening 327F to retain the first ball 33F from dropping out of the first passage 321F. The first plug cover 328F has a first plug cover hole 3281F. An inner diameter of the first plug cover hole 3281F is smaller than an outer diameter of the first ball 33F. Moreover, the second plug cover 330F is detachably mounted on the second opening 329F to retain the second ball 34F from dropping out of the second passage 323F. The second plug cover 330F has a second plug cover hole 3301F.

An inner diameter of the second plug cover hole 3301F is smaller than an outer diameter of the second ball 34F. In other words, in the second embodiment, the first plug cover 328F and the second plug cover 330F do not seal the first opening 327F and the second opening 329F, but are only mounted on the first opening 327F and the second opening 329F to retain the first ball 33F and the second ball 34F from dropping out. The configuration of the first plug cover hole 3281F and the second plug cover hole 3301F facilitates the liquid product A to flow in or out of the first passage 321F and the second passage 323F smoothly and continuously, especially when the can body 10 is placed horizontally and openings of the first passage 321F and the second passage 323F are immersed in the liquid product A. Otherwise, if there is not a hole formed on each of the first plug cover 328F and the second plug cover 330F, when the ball abuts the back of the cover, there must be a slight liquid adhesive force between the cover and the ball, such that the first ball 33F and the second ball 34F cannot move swiftly when the can body 10 is slowly inclined from the horizontal spray condition with the actuator 20 facing upward or downward and thus impairing the product functions. The configuration of the first plug cover hole 3281F and the second plug cover hole 3301F therefore facilitate a fast and precise shifting manner between different spraying conditions.

Besides, in the second embodiment, a ball-supporting circular rib 3282F is formed along the back edge of the first plug cover hole 3281F. The first ball 33F selectively abuts the first plug cover ball-supporting circular rib 3282F to block the first plug cover hole 3281F. A first passage ball-supporting circular rib 3214F is formed on a top of the first passage 321F. The first ball 33F selectively abuts the first passage ball supporting circular rib 3214F to block the first linking opening 3211F. Specifically, when the first ball 33F abuts the first plug cover ball-supporting circular rib 3282F or the first passage ball-supporting circular rib 3214F, there is a gap between the first ball 33F and an inner surface of the first passage 321F so that the first ball 33F can smoothly move between the top end of the first passage 321F and the first plug cover 328F. A second plug cover ball-supporting circular rib 3302F is formed along the back edge of the second plug cover hole 3301F. The second ball 34F selectively abuts the second plug cover ball-supporting circular rib 3302F to block the second plug cover hole 3301F. A second passage ball-supporting circular rib 3234F is formed on a bottom end of the second passage 323F. The second ball 34F selectively abuts the second passage ball-supporting circular rib 3234F to block the second linking opening 3231F. Specifically, when the second ball 34F abuts the second plug cover ball-supporting circular rib 3302F or the second passage ball-supporting circular rib 3234F, there is a gap between the second ball 34F and the second passage 323F so that the second ball 34F can smoothly move between the bottom end of the second passage 323F and the second plug cover 330F.

The advantages of the present invention are as follows: With reference to FIGS. 4 and 5, the first passage 321 and the second passage 323 are configured to keep the upright-spraying suction port 322 and the inverted-spraying suction port 324 linking the flow with the liquid product inlet 315 of the valve assembly 31 respectively via the first passage 321 and the second passage 323. The first ball 33 and the second ball 34 are movably mounted in the first passage 321 and the second passage 323 respectively so the first ball 33 and the second ball 34 can control the upright-spraying suction port 322 and the inverted-spraying suction port 324 to link the flow with the liquid product inlet 315 or blocked. By this, when the can body 10 is placed upright to spray, the first ball 33 is driven by the gravity and slides down to make the upright-spraying suction port 322 linking the flow with the liquid product inlet 315 while the second ball 34 is also driven by the gravity and slides down to block the second linking opening 3231 such that the inverted-spraying suction port 324 and the liquid product inlet 315 are blocked. When the can body 10 is placed upside down to spray, the second ball 34 is driven by the gravity and slides down to make the inverted-spraying suction port 324 link the flow with liquid product inlet 315 while the first ball 33 is also driven by the gravity and slides down to block the first linking opening 3211 such that the upright-spraying suction port 322 and the liquid product inlet 315 are blocked. As a result, no matter whether the can body 10 is placed upright or upside down to spray, there is always a ball blocking the suction port whichever is not immersed in the liquid product A. Therefore, compared to the conventional valve assembly or valve mechanism, the present invention prevents the propellant B from leaking when the can body 10 is placed both upright and upside down to spray, and provides the user with a smooth spraying experience during work without disturbance.

Besides, with reference to FIG. 6, when the can body 10 is placed horizontal to spray, since the first inclined inner wall surface 3212 and the second inclined inner wall surface 3232 are inclined downward, the first ball 33 abuts the first inclined inner wall surface 3212 and quickly slides down toward the bottom end of the can body 10 to the lower end of the first inclined inner wall surface 3212, thereby making the upright-spraying suction port 322 link the flow with the liquid product inlet 315. At the same time, the second ball 34 abuts the second inclined inner wall surface 3232 and quickly slides toward the top end of the can body 10 to the lower end of the second inclined inner wall surface 3232, thereby making the inverted-spraying suction port 324 link the flow with the liquid product inlet 315. In other words, when the can body 10 is placed horizontal to spray, due to the configuration of the first inclined inner wall surface 3212 and the second inclined inner wall surface 3232, the first ball 33 and the second ball 34 move in co-motion respectively to the two lower ends of the two passages, therefore opening both the upright-spraying suction port 322 and the inverted-spraying suction port 324, and preventing the two balls from drifting in the two passages to intermittently link or block the two suction ports, which disturbs the flow of the liquid product A and makes the liquid product A sprayed intermittently.

Since the valve mechanism described above is configured with a switching base comprising two linking passages, two linking openings, two inclined inner wall surfaces, two suction ports and two balls; therefore, the present invention can quickly shift spray operation among upright, horizontal and upside-down conditions, and prevents the propellant B from leaking during shifting among above conditions, and such function is absent from conventional valve assembly or valve mechanism.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A valve mechanism for a high-pressure spray can, adapted to be mounted on a can body of the high-pressure spray can and being capable of providing communication between an interior and an exterior of the can body; the can body having an inner space and a can-mounting opening; the valve mechanism for the high-pressure spray can comprising:

a first reference direction being parallel to an axis of the can body and toward a top end of the can body;

a second reference direction being vertical to the first reference direction and pointing radially outward of the can body;

a third reference direction being parallel to the axis of the can body and toward a bottom end of the can body;

a valve assembly fixed on the can-mounting opening of the can body and sealing the can-mounting opening of the can body; the valve assembly having a liquid product outlet located outside the can body;

a liquid product inlet located in the inner space of the can body; which selectively links the flow with the liquid product outlet; and a switching base connected to a bottom end of the valve assembly and linking the flow with the valve assembly; the switching base having a main body having a first passage having a first end pointing toward the first reference direction;

a second end pointing toward the third reference direction;

a first linking opening formed on the first end of the first passage and linking the flow with the liquid product inlet; and a first inclined inner wall surface located in a side of the first passage facing toward the second reference direction; the first inclined inner wall surface being inclined with respect to the axis of the can body and extending obliquely from the first end of the first passage to the second end of the first passage;

a first suction port linking the flow with the first passage; the first suction port linking the flow with the liquid product inlet via the first linking opening of the first passage;

a second passage having a first end pointing toward the third reference direction;

a second end pointing toward the first reference direction;

a second linking opening formed on the first end of the second passage and linking the flow with the liquid product inlet; and a second inclined inner wall surface located in a side of the second passage facing toward the second reference direction; the second inclined inner wall surface being inclined with respect to the axis of the can body and extending obliquely from the first end of the second passage to the second end of the second passage; and a second suction port linking the flow with the second passage; the second suction port linking the flow with the liquid product inlet via the second linking opening of the second passage;

a first ball movably mounted in the first passage and selectively linking the first suction port and the liquid product inlet or blocking the first suction port and the liquid product inlet; and a second ball movably mounted in the second passage and selectively linking the second suction port and the liquid product inlet or blocking the second suction port and the liquid product inlet;

wherein when the can body is placed upright and the first reference direction is perpendicularly upward, the first ball slides down to a first opening position such that the first suction port is linking the flow with the liquid product inlet, and the second ball slides down to a second blocking position to block the second linking opening such that the second suction port and the liquid product inlet are blocked by the second ball;

when the can body is placed upside down and the first reference direction is perpendicularly downward, the second ball slides down to a second opening position such that the second suction port is linking the flow with the liquid product inlet, and the first ball slides down to a first blocking position to blocks the first linking opening such that the first suction port and the liquid product inlet are blocked by the first ball;

the first inclined inner wall surface extends to the first opening position and the first blocking position;

the second inclined inner wall surface extends to the second opening position and the second blocking position; and when the can body is placed horizontally and the second reference direction is perpendicularly downward, the first ball abuts the first inclined inner wall surface and stays at a lower end of the first inclined inner wall surface such that the first suction port is linking the flow with the liquid product inlet, and the second ball abuts the second inclined inner wall surface and stays at a lower end of the second inclined inner wall surface such that the second suction port is linking the flow with the liquid product inlet; the first inclined inner wall surface and the second inclined inner wall surface are inclined to a different direction such that the first ball and the second ball slide down in co-motion to open the first suction port and the second suction port.

2. The valve mechanism for the high-pressure spray can as claimed in claim 1, wherein an angle between the first inclined inner wall surface and the first reference direction is 1 to 3 degrees; and an angle between the second inclined inner wall surface and the third reference direction is 1 to 3 degrees.

3. The valve mechanism for the high-pressure spray can as claimed in claim 2, wherein an angle between the first inclined inner wall surface and the first reference direction is 1.5 degrees; and an angle between the second inclined inner wall surface and the third reference direction is 1.5 degrees.

4. The valve mechanism for the high-pressure spray can as claimed in claim 1, wherein the main body of the switching base has a common passage linking the flow with the liquid product inlet; the first linking opening and the second linking opening linking the flow with the liquid product inlet via the common passage; and a partition wall mounted in the common passage and located between the first linking opening and the second linking opening.

5. The valve mechanism for the high-pressure spray can as claimed in claim 3, wherein the main body of the switching base has a common passage linking the flow with the liquid product inlet; the first linking opening and the second linking opening linking the flow with the liquid product inlet via the common passage; and a partition wall mounted in the common passage and located between the first linking opening and the second linking opening.

6. The valve mechanism for the high-pressure spray can as claimed in claim 4, wherein the first passage, the first suction port, the second passage, and the second suction port of the switching base are formed on the main body; and the main body has a first opening located in the second end of the first passage pointing toward the third reference direction; the first ball is placed in or removed from the first passage via the first opening;

a first plug cover detachably sealing the first opening;

a second opening located in the second end of the second passage pointing toward the first reference direction; the second ball can be placed in or removed from the second passage via the second opening;

a second plug cover detachably sealing the second opening;

a third opening located on a side of the main body facing toward the second reference direction, and linking the flow with the first linking opening;

a third plug cover detachably sealing the third opening and having a third-plug-cover-guiding wall forming a curved linking passage with the main body, and the curved linking passage linking flow between the first suction port and the first passage;

a fourth opening formed on the main body, located on the side of the main body facing toward the second reference direction, and linking the flow with the second linking opening; and a fourth plug cover detachably sealing the fourth opening and having a fourth-plug-cover-guiding wall forming a curved linking passage with the main body, and the curved linking passage linking flow between the second linking opening and the common passage.

7. The valve mechanism for the high-pressure spray can as claimed in claim 5, wherein the first passage, the first suction port, the second passage, and the second suction port of the switching base are formed on the main body; and the main body has a first opening located in the second end of the first passage pointing toward the third reference direction; the first ball can be placed in or removed from the first passage via the first opening;

a first plug cover detachably sealing the first opening;

a second opening located in the second end of the second passage; the second ball can be placed in or removed from the second passage via the second opening;

a second plug cover detachably sealing the second opening;

a third opening located on a side of the main body facing toward the second reference direction, and linking the flow with the first linking opening;

a third plug cover detachably sealing the third opening and having a third-plug-cover-guiding wall forming a first curved connecting passage with the main body, and the first curved connecting passage connected between the first suction port and the first passage;

a fourth opening formed on the main body, located on the side of the main body facing toward the second reference direction, and linking the flow with the second linking opening; and a fourth plug cover detachably sealing the fourth opening and having a fourth-plug-cover-guiding wall forming a second curved linking passage with the main body, and the second curved linking passage linking between the second linking opening and the common passage.

8. The valve mechanism for the high-pressure spray can as claimed in claim 1, wherein the main body has an inverted-spraying extending tube extending toward the second reference direction; the second suction port formed on one end of the inverted-spraying extending tube pointing toward the second reference direction.

9. The valve mechanism for the high-pressure spray can as claimed in claim 7, wherein the main body has an inverted-spraying extending tube extending toward the second reference direction; the second suction port formed on one end of the inverted-spraying extending tube pointing toward the second reference direction.

10. The valve mechanism for the high-pressure spray can as claimed in claim 1, wherein the first passage and the second passage are formed on the main body; and the main body has an upright-spraying extending tube linking the flow with the first suction port, and extending toward the third reference direction.

11. The valve mechanism for high-pressure spray can as claimed in claim 7, wherein the first passage and the second passage are formed on the main body; and the main body has an upright-spraying extending tube linking the flow with the first suction port, and extending toward the third reference direction.

12. The valve mechanism for the high-pressure spray can as claimed in claim 1, wherein the first inclined inner wall surface has two first rib-shaped sliding tracks extending along the first inclined inner wall surface, spaced apart from each other, and adjacent to two sides of the first suction port; the first ball movably abutting the two first rib-shaped sliding tracks such that a gap is formed between the first ball and the first inclined inner wall surface; and the second inclined inner wall surface has two second rib-shaped sliding tracks extending along the second inclined inner wall surface, spaced apart from each other, and respectively adjacent to two sides of the second suction port; the second ball movably abutting the two second rib-shaped sliding tracks such that a gap is formed between the second ball and the second inclined inner wall surface.

13. The valve mechanism for the high-pressure spray can as claimed in claim 1, wherein the main body of the switching base has a first opening formed on the main body and located in one end of the first passage toward the third reference direction; the first ball can be placed in or removed from the first passage via the first opening;

a first plug cover detachably mounted on the first opening and blocking the first ball from dropping out from the first passage; the first plug cover having a first plug cover hole; an inner diameter of the first plug cover hole being smaller than an outer diameter of the first ball;

a second opening formed on the main body and located in one end of the second passage toward the first reference direction; the second ball can be placed in or removed from the second passage via the second opening; and a second plug cover detachably mounted on the second opening and blocking the second ball from dropping out from the second passage; the second plug cover having a second plug cover hole; an inner diameter of the second plug cover hole being smaller than an outer diameter of the second ball.

14. The valve mechanism for the high-pressure spray can as claimed in claim 13, wherein a first plug cover ball-supporting circular rib is formed along the back edge of the plug cover hole; the first ball selectively abuts the first plug cover ball-supporting circular rib to block seal the first plug cover hole;

a first passage ball-supporting circular rib is formed along the top edge of the first passage; the first ball selectively abuts the first passage ball-supporting circular rib to block the first linking opening;

a second plug cover ball-supporting circular rib is formed along the back edge of the plug cover hole; the second ball selectively abuts the second plug cover ball-supporting circular rib to block the second plug cover hole; and a second passage ball-supporting circular rib is formed along the bottom edge of the second passage; the second ball selectively abuts the second passage ball-supporting circular rib to block the second linking opening.

15. A high-pressure spray can comprising:

a can body having an inner space; and a can-mounting opening linking the flow with the inner space; an actuator having a nozzle; and a valve mechanism mounted on the can body of the high-pressure spray can and being capable of providing communication between an interior and an exterior of the can body; the valve mechanism having a first reference direction being parallel to an axis of the can body and toward a top end of the can body;

a second reference direction being vertical to the first reference direction and pointing radially outward of the can body;

a third reference direction being parallel to the axis of the can body and toward a bottom end of the can body;

a valve assembly fixed on the can-mounting opening of the can body and sealing the can-mounting opening of the can body; the valve assembly having a liquid product outlet located outside the can body;

a liquid product inlet located in the inner space of the can body; which selectively links the flow with the liquid product outlet; and a switching base connected to a bottom end of the valve assembly and linking the flow with the valve assembly; the switching base having a main body having a first passage having a first end pointing toward the first reference direction;

a second end pointing toward the third reference direction;

a first linking opening formed on the first end of the first passage and linking the flow with the liquid product inlet; and a first inclined inner wall surface located in a side of the first passage facing toward the second reference direction; the first inclined inner wall surface being inclined with respect to the axis of the can body and extending obliquely from the first end of the first passage to the second end of the first passage;

a first suction port linking the flow with the first passage; the first suction port linking the flow with the liquid product inlet via the first linking opening of the first passage;

a second passage having a first end pointing toward the third reference direction;

a second end pointing toward the first reference direction;

a second linking opening formed on the first end of the second passage and linking the flow with the liquid product inlet; and a second inclined inner wall surface located in a side of the second passage facing toward the second reference direction; the second inclined inner wall surface being inclined with respect to the axis of the can body and extending obliquely from the first end of the second passage to the second end of the second passage; and a second suction port linking the flow with the second passage; the second suction port linking the flow with the liquid product inlet via the second linking opening of the second passage;

a first ball movably mounted in the first passage and selectively linking the first suction port and the liquid product inlet or blocking the first suction port and the liquid product inlet; and a second ball movably mounted in the second passage and selectively linking the second suction port and the liquid product inlet or blocking the second suction port and the liquid product inlet;

wherein when the can body is placed upright and the first reference direction is perpendicularly upward, the first ball slides down to a first opening position such that the first suction port is linking the flow with the liquid product inlet, and the second ball slides down to a second blocking position to block the second linking opening such that the second suction port and the liquid product inlet are blocked by the second ball;

when the can body is placed upside down and the first reference direction is perpendicularly downward, the second ball slides down to a second opening position such that the second suction port is linking the flow with the liquid product inlet, and the first ball slides down to a first blocking position to blocks the first linking opening such that the first suction port and the liquid product inlet are blocked by the first ball;

the first inclined inner wall surface extends to the first opening position and the first blocking position;

the second inclined inner wall surface extends to the second opening position and the second blocking position;

when the can body is placed horizontally and the second reference direction is perpendicularly downward, the first ball abuts the first inclined inner wall surface and stays at a lower end of the first inclined inner wall surface such that the first suction port is linking the flow with the liquid product inlet, and the second ball abuts the second inclined inner wall surface and stays at a lower end of the second inclined inner wall surface such that the second suction port is linking the flow with the liquid product inlet; the first inclined inner wall surface and the second inclined inner wall surface are inclined to a different direction such that the first ball and the second ball slide down in co-motion to open the first suction port and the second suction port;

the valve mechanism is mounted on the can body and is capable of providing communication between an interior and an exterior of the can body;

the first reference direction is parallel to an axis of the can body;

the valve assembly is fixed on the can-mounting opening, seals the can-mounting opening, and is connected to the actuator; and the liquid product outlet of the valve assembly is linking the flow with the nozzle of the actuator.

16. The high-pressure spray can as claimed in claim 15, wherein the valve mechanism has an upright-spraying dip tube mounted on the switching base and linking the flow with the first suction port; an end of the upright-spraying dip tube extending in the second reference direction and the third reference direction, and extending to a bottom of the can body.

17. The high-pressure spray can as claimed in claim 16, wherein the main body has an upright-spraying extending tube linking the flow with the first suction port, and extending toward the third reference direction; the upright-spraying dip tube mounted on the upright-spraying extending tube.

18. The high-pressure spray can as claimed in claim 15, wherein the valve mechanism has an inverted-spraying dip tube mounted on the switching base and linking the flow with the second suction port; the inverted-spraying dip tube being L-shaped, and an end of the inverted-spraying dip tube extending in the second reference direction then the first reference direction to the top end of the can body; the inverted-spraying dip tube having a connecting end mounted on an inverted-spraying extending tube of the main body of the switching base; and a retaining groove engaging with a positioning rib of the inverted-spraying extending tube.

19. The high-pressure spray can as claimed in claim 18, wherein the inverted-spraying extend extends tube extending toward the second reference direction; the second suction port is formed on one end of the inverted-spraying extending tube toward the second reference direction.

* * * * *